US008443566B2

(12) United States Patent
Wennberg

(10) Patent No.: US 8,443,566 B2
(45) **Date of Patent: *May 21, 2013**

(54) BUILDING STRUCTURED MATERIAL USING CELL GEOMETRY

(76) Inventor: Paul Wennberg, Redmond, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/036,239

(22) Filed: Feb. 28, 2011

(65) Prior Publication Data

US 2011/0162311 A1 Jul. 7, 2011

Related U.S. Application Data

(63) Continuation of application No. 11/933,949, filed on Nov. 1, 2007.

(60) Provisional application No. 61/308,808, filed on Feb. 26, 2010, provisional application No. 60/916,827, filed on May 9, 2007.

(51) Int. Cl.
*E04B 2/08* (2006.01)

(52) U.S. Cl.
USPC ..... 52/589.1; 52/667; 52/784.14

(58) Field of Classification Search
USPC ..... 52/589.1, 724.3, 667, 793.1, 784.14, 52/655.2; 446/124, 125, 126
See application file for complete search history.

(56) References Cited

U.S. PATENT DOCUMENTS

| | | | | | |
|---|---|---|---|---|---|
| 1,851,159 | A * | 3/1932 | Dodge | ..... | 434/278 |
| 2,776,521 | A * | 1/1957 | Zimmerman | ..... | 446/115 |
| 3,085,963 | A * | 4/1963 | Martin | ..... | 376/459 |
| 4,020,566 | A * | 5/1977 | Dreiding | ..... | 434/278 |
| 4,129,975 | A * | 12/1978 | Gabriel | ..... | 52/655.2 |
| 4,197,669 | A * | 4/1980 | Hynes | ..... | 446/125 |
| 5,350,331 | A * | 9/1994 | Glickman | ..... | 446/126 |

* cited by examiner

*Primary Examiner* — Basil Katcheves
(74) *Attorney, Agent, or Firm* — Lowe Graham Jones PLLC

(57) ABSTRACT

An improved cellular building block including a middle beam and two legs. The cellular building block having the first leg coupled to the middle beam such that the leg is perpendicular to the middle beam and a second leg coupled to the middle beam such that the leg is perpendicular to the middle beam and spaced apart from the first leg, the first leg and the second leg having an inside edge and an outside edge. Having at least one barb located on the inside edge of the first leg and on the inside edge of the second leg and further configured to lock into a recess. The cellular building blocks connect in a two dimensional or three dimensional pattern and a produce a structured material that holds itself together and exhibits beneficial characteristics.

2 Claims, 37 Drawing Sheets

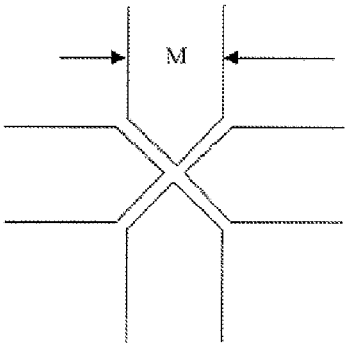
FIG 8A
FIG 8B
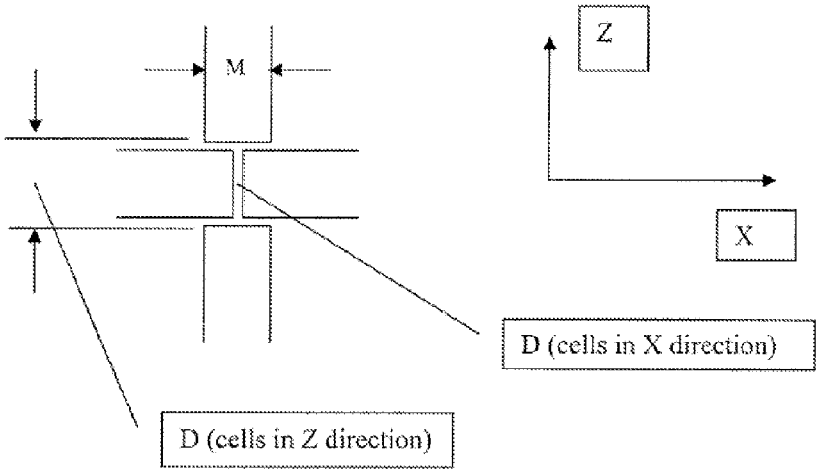
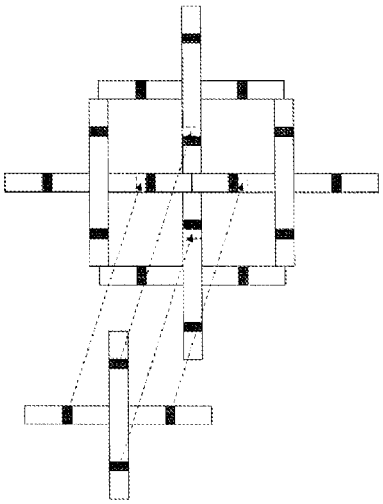
FIG 8C

BUILDING STRUCTURED MATERIAL USING CELL GEOMETRY

PRIORITY CLAIM

This application is a continuation of U.S. patent application Ser. No. 11/933,949 filed Nov. 1, 2007 which claims the benefit of U.S. Provisional Application Ser. No. 60/916,927 filed on May 9, 2007, and U.S. Provisional Application Ser. No. 61/308,808 filed on Feb. 26, 2010, which applications are herein incorporated by reference in their entirety.

FIELD OF THE INVENTION

This invention related generally to structured building materials and, more specifically, to cellular building blocks configured to connect in a multi-dimensional pattern to produce an improved structured building material exhibiting beneficial characteristics.

BACKGROUND OF THE INVENTION

Wood is a preferred material for building structures because it has high strength, low density and it may be sawed, cut and/or have a nail driven into it. However, in some areas, there is a limited supply of wood to use as a building material. There currently exists a need for a replacement for wood but that has similar characteristics to wood. Finally, it could be manufactured using local materials, without trees and with minimal expense. Artificially mimicking wood's cell structure may provide a variety of benefits such as:

- Building a large structure made of smaller, easy to transport parts
- Imparting redundancy, survivability, and reliability to a material that may suffer damage, including earthquake resistance
- Using a robotic assembler to build large structures using standard small interconnected cells
- Mitigating deforestation

SUMMARY OF THE INVENTION

A cellular building block that connects in a two dimensional or three dimensional pattern to produce a structured material that holds itself together. The cellular building block may be made of many base materials, sizes, and geometrical variations that result in various applications.

In one embodiment a cell uses a variety of different types of materials made separately into cells and connected mechanically using different geometries. These geometries include, but are not limited to, rectangular and hexagonal geometries, which provide cohesion and strength based on the geometry of the composition. The different geometries combine materials at a cellular level to produce advantageous characteristics in the resulting composition. The advantageous properties include, but are not limited to, low density, strength, toughness, and/or fire resistance.

A cellular building block made of various materials depending on the application. The cells may be two dimensional (2D) defined as cells which connect together to produce a two dimensional structure of some height and width, but preferably are only as deep as the depth of the cell itself. The cells may be three dimensional (3D), consisting of a pair of 2D cells at right angles, and defined as connecting together to produce a three dimensional structure of some height, width, and depth, for example, hexagonal in design. A group of connected 2D cells is defined as an array. A group of connected 3D cells is defined as a lattice. Arrays or lattices of cells may form a structure such as a beam that holds itself together even at the edges.

BRIEF DESCRIPTION OF THE DRAWINGS

The preferred and alternative embodiments of the present invention are described in detail below with reference to the following drawings.

FIGS. 8A-8C shows the middle beam intersection of four three dimensional cells;

DETAILED DESCRIPTION OF THE PREFERRED EMBODIMENT

In one embodiment a cell uses a variety of different types of materials made separately into cells and connected mechanically using different geometries. These geometries include, but are not limited to, rectangular and prismatic geometries, which provide cohesion and strength based on the geometry of the composition. The different geometries combine materials at a cellular level to produce advantageous characteristics in the resulting composition. The advantageous properties include, but are not limited to, low density, strength, toughness, and/or fire resistance.

Figure 1:
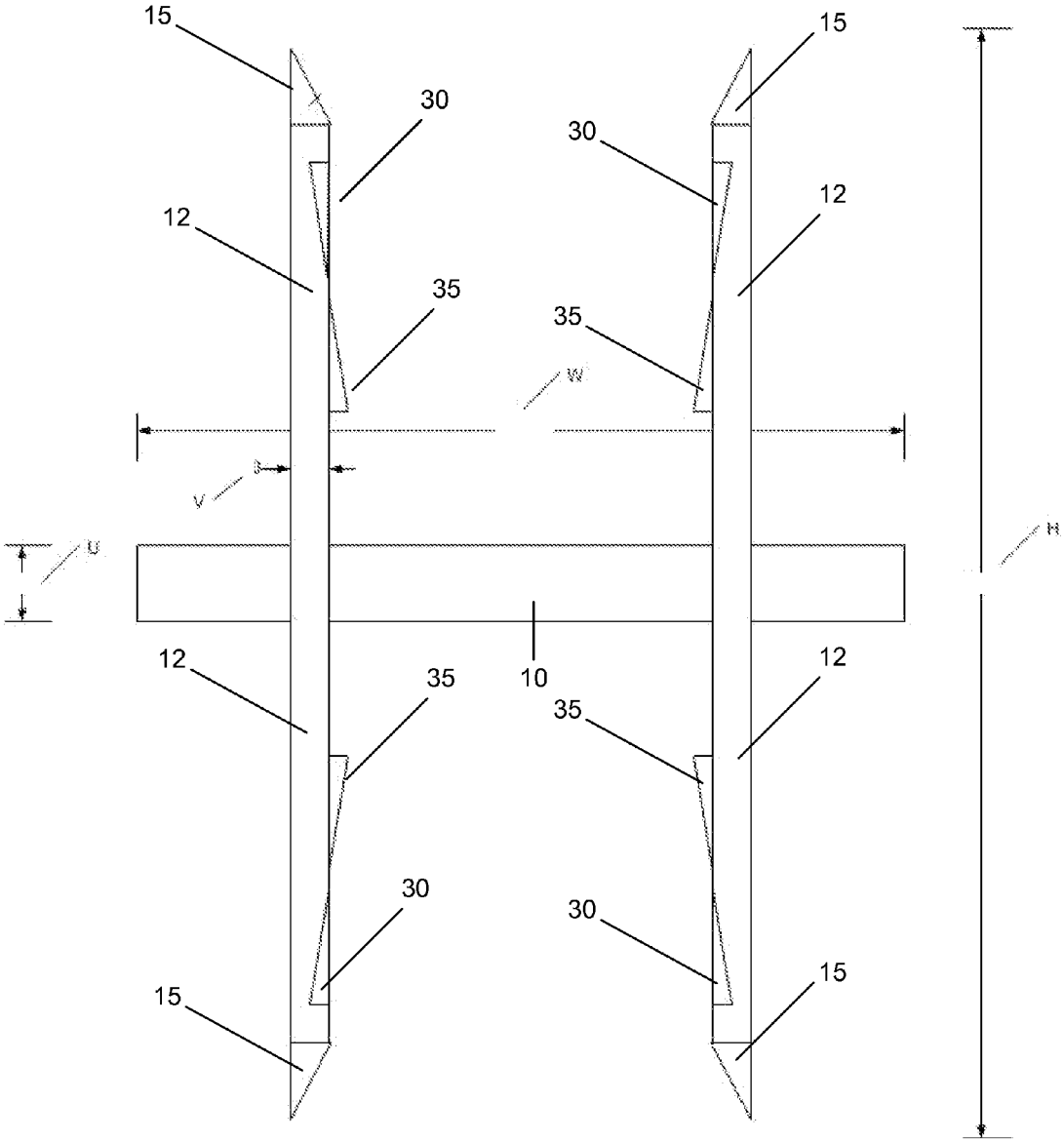
FIG. 1 shows a two-dimensional top view of one embodiment.

FIG. 1 shows a two-dimensional top view of one embodiment. The cell has a middle beam 10. The middle beam has a width, a length and a depth. The cell has two legs 12, each leg connected along the width (X axis) of the middle beam. Each leg has a length and a width. At each end of the legs is a guide 15. The guide allows for easy connection with another cell. The leg has a barb 35 located on the inside of the leg. The barb is configured to securely lock in the recess 30. The cell is composed of, but not limited to, at least one of ceramics, metals, concrete, stone, clay and plastic. These cells are made with a machine or manually by a human in the manual process. In one embodiment the cells range from 1 mm to 10 cm.

FIG. 1 further shows the important dimensions of a cell. The width of the cell W is measured along the cells X axis. The height of the cell H is measured along the cell's Y axis. The gap between cell middle beam intersections is represented by D. The width of each leg is represented by V. The depth of the middle beam, M, is measured along the cell's z axis. Finally, U is the width of the middle beam and is measured along its Y axis.

The following dimensions are derived in one embodiment. The depth of each barb A is derived from the width of each leg V divided by four. The length of each barb B is derived from the depth of the barb multiplied by eight. The distance between the legs P is derived from the basic width of the cell divided by two. The distance between the center lines of the legs Q is derived from the distance between the legs P added to the width of a leg V. The distance between outside lines of the legs R is derived from the distance between the center lines of the legs Q added to the width of the leg V. The length of a leg G is derived from the width of the middle beam U subtracted from the height of the cell H and then divided by two. The resulting number is then multiplied by 0.95 to find the length of the leg. The length of the middle beam S is derived from the gap between adjacent cell middle beams D subtracted from the basic width of the cell W. The distance from the outside of the leg to the middle beam intersection N is derived from the distance between the outside lines of the legs R subtracted from the basic width of the cell W and then divided by two.

In one embodiment, it is preferred, but not necessary, to have the following relationships. The depth of each barb is less than or equal to the width of each leg divided by two. The length of each barb is greater than two times the depth of the barb. The depth of the barb is two times the gap between adjacent cell middle beam intersections. The length of a leg is less than the width of the middle beam subtracted from the basic height of the cell and then divided by two. In a three-dimensional cell, the depth of the middle beam is less than the distance from the outside of the leg to the middle beam intersection. Further the depth of the barb is also constrained by the elasticity of the material and the length of the leg in one embodiment. As a cell is coupled to another, the legs will bend slightly to overcome the depth of the barb until the barb reaches the recess.

In an alternate embodiment the barbs are removed from one end and recesses are removed from the other end resulting in a cell that is polarized. The cell would have a positive and negative side, and as long as the cells were organized with the correct polarization would form a lattice. In yet another alternate embodiment the cells may be connected without barbs or recesses using rivets, pins and/or screws.

Figure 2:
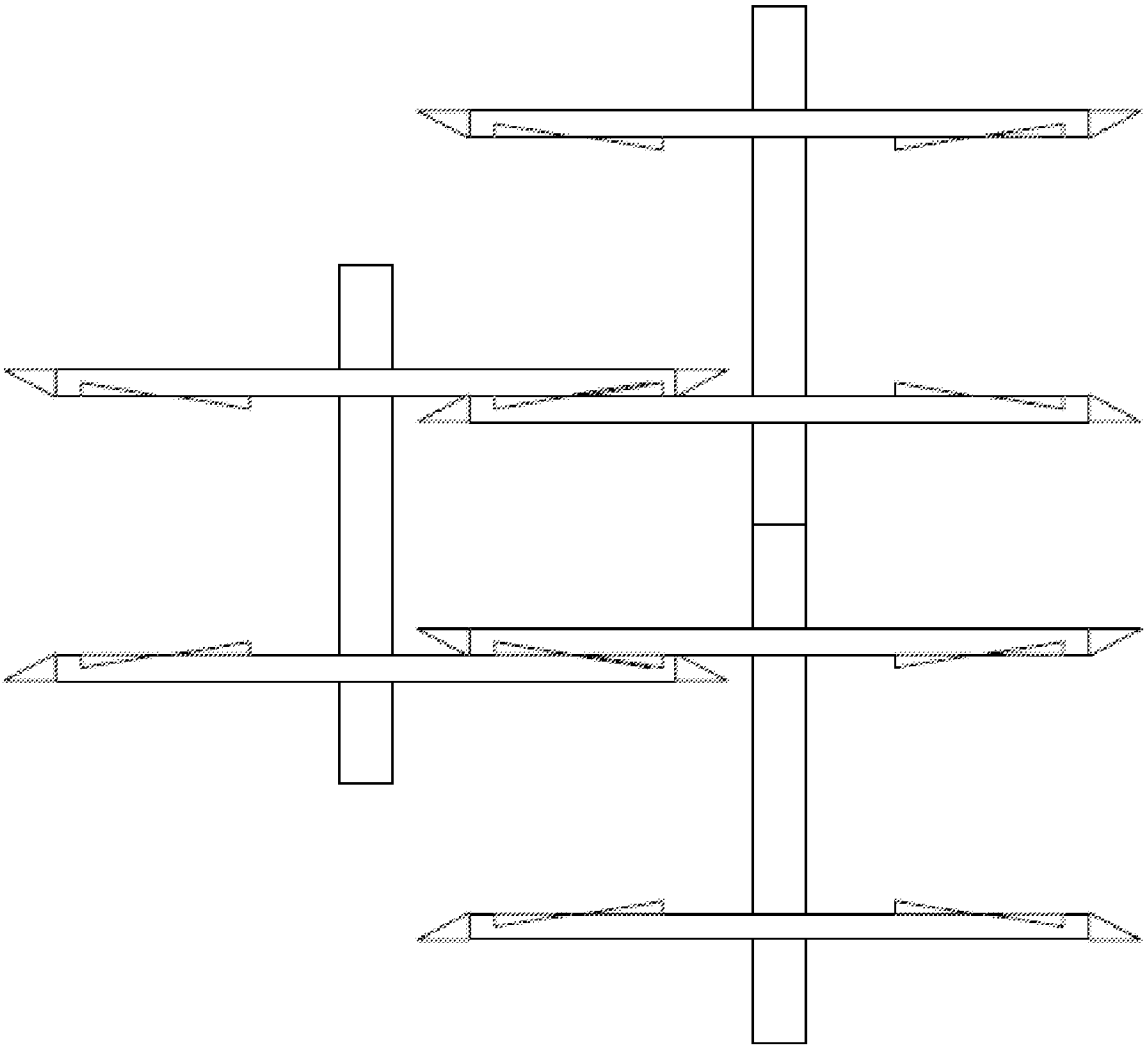
FIG. 2 is a top view showing the basic connection of three cells in a two-dimensional arrangement.

FIG. 2 is a top view showing the basic connection of three cells in a two-dimensional arrangement. As shown two-dimensional cells are connected together to form an array. The cells in two dimensions are designed such that if the two-dimensional array is subject to bending forces then the bending is distributed among all cell structures. Further damage or a crack to one cell will not propagate to others.

Figure 3A:
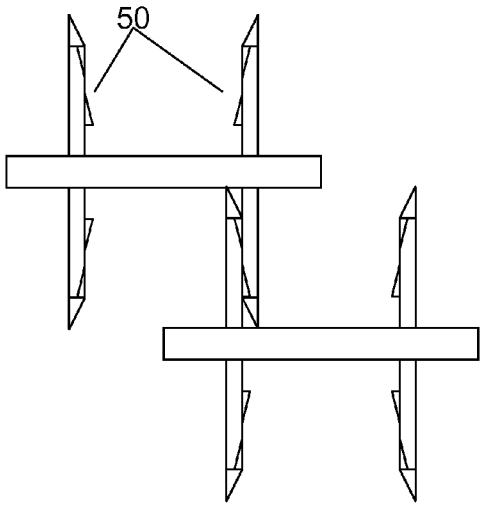
FIGS. 3A-3D show multiple connection methods of cells in a two-dimensional arrangement.
Figure 3B:
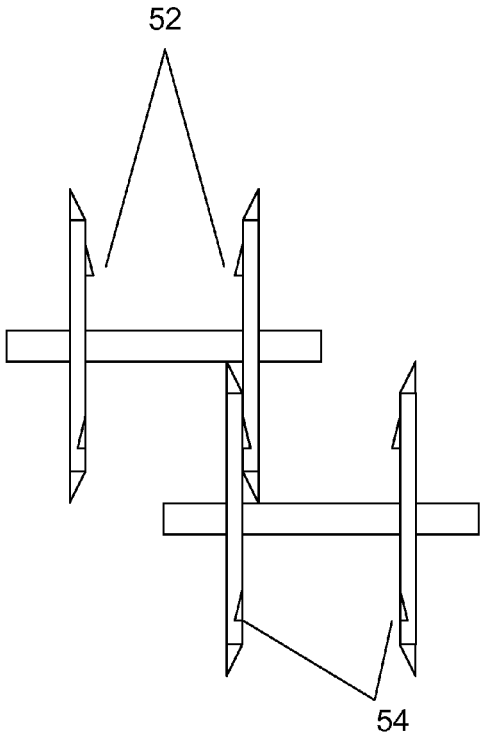

FIGS. 3A-3D show multiple connection methods of cells in a two-dimensional arrangement. FIG. 3A shows a cell with bidirectional barbs 50, also shown in FIG. 1. The barbs shown are symmetrical. FIG. 3B shows a cell with polarized barbs.

Figure 3C:
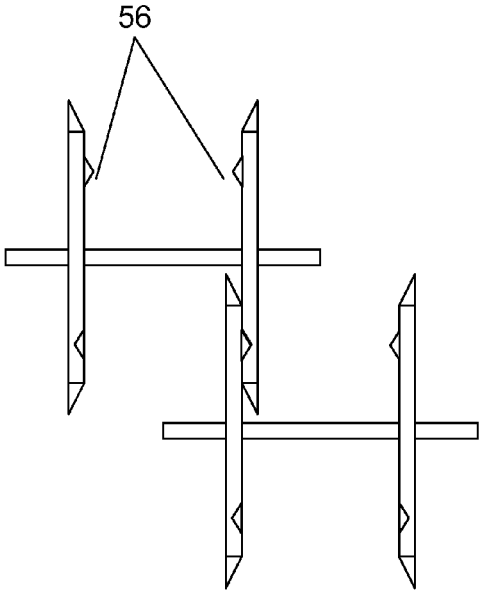
Figure 3D:
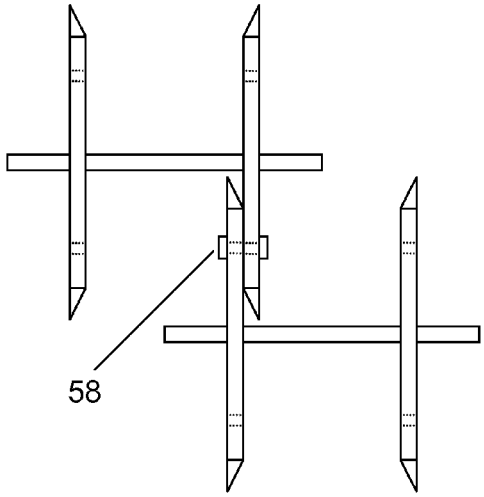
Figure 4A:
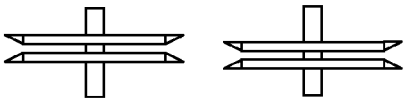
FIGS. 4A-4E show multiple embodiments of cell end pieces.
Figure 4B:
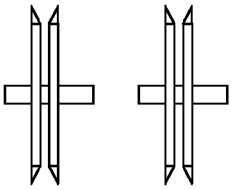
Figure 4C:
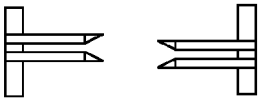
Figure 4D:
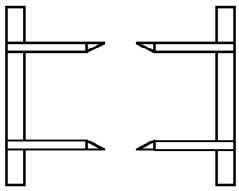
Figure 4E:
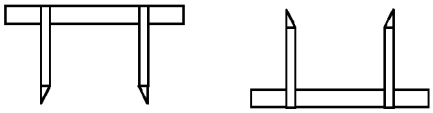

One side as protruding barbs 52, wherein the other side has a matching indent 54. The cells in this arrangement connect in one direction. FIG. 3C shows a cell with a polarized and removable connection 56. If the cell is connected horizontally and in this configuration the cell would have a spring constantly dependent on the shape and depth of the protrusions and indents. FIG. 3D shows cells preferably connected by a fastener 58, such as screw, rivet, or push pin through a hole.

FIGS. 4A-4E show multiple embodiments of cell end pieces. In one embodiment cells may be modified to be end pieces. As a result a block of cells will preferably have a smoother surface.

Figure 5A:
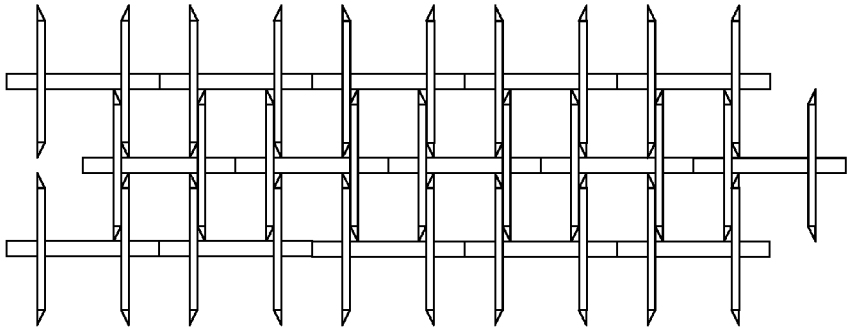
FIGS. 5A-5B show cells connected vertically and horizontally in one embodiment.
Figure 5B:
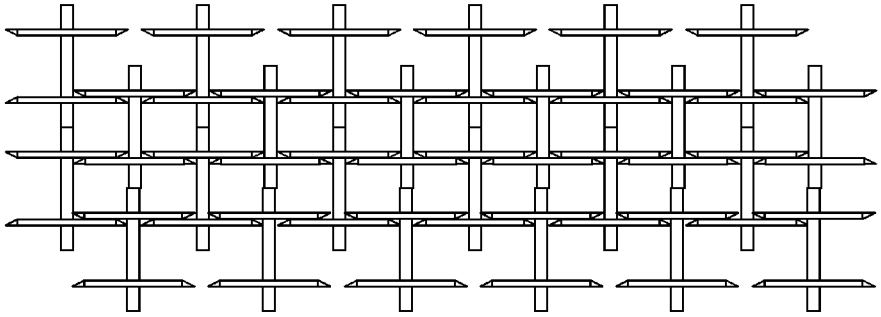

FIGS. 5A-5B show cells connected vertically and horizontally in one embodiment. FIG. 5A shows cells connected vertically. When connected vertically compression and tension forces are evenly distributed. In this case there is a low shear stress put on the vertical cell leg connections. FIG. 5B shows cells connected horizontally. In this case more shear stress is put on the cell leg connections; however, there are many advantages to this arrangement.

Figure 6A:
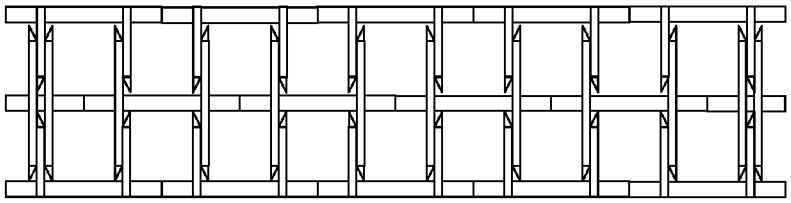
FIGS. 6A-6B show cells connected vertically and horizontally with end pieces attached in one embodiment.
Figure 6B:
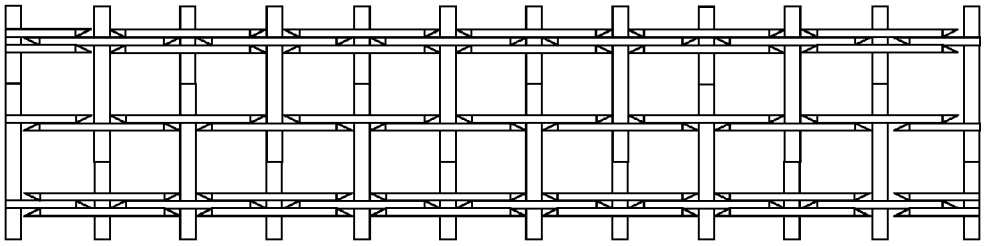

FIGS. 6A-6B show cells connected vertically and horizontally with end pieces attached in one embodiment. FIG. 6A shows cells connected vertically with end pieces attached to provide a generally smooth surface. FIG. 6B shows cells connected horizontally with end pieces attached to provide a generally smooth surface.

Figure 7:
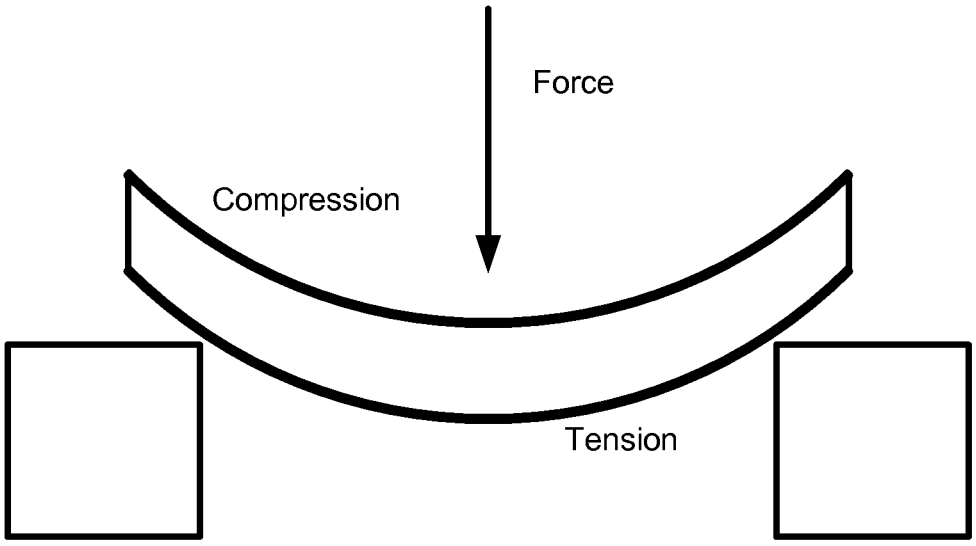
FIG. 7 shows a sample of the force applied to a series of connected cells.

FIG. 7 shows a sample of the force applied to a series of connected cells. In one embodiment compression and tension forces are distributed evenly when force is applied.

FIGS. 8A-8C shows the middle beam intersection of four three-dimensional cells in a lattice. The gap between the middle beam intersections D is represented both along the X and the Z axis. The depth of the middle beam is represented by M. FIG. 8C shows a top view of four three-dimensional cells, the legs are grey in this top view.

Figure 9A:
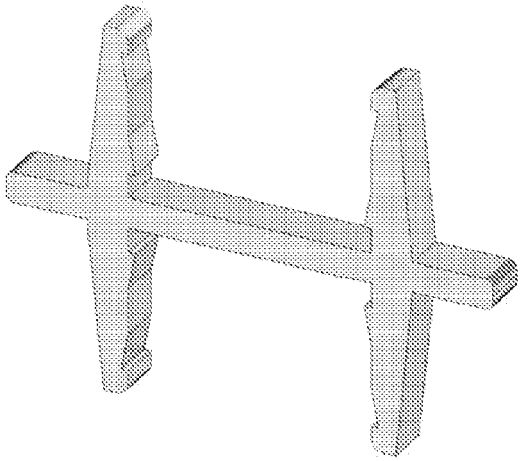
FIG. 9A shows a 2D cell that has top/bottom and left/right symmetry. The cell uses the locking barb snap together connection mechanism.
Figure 9B:
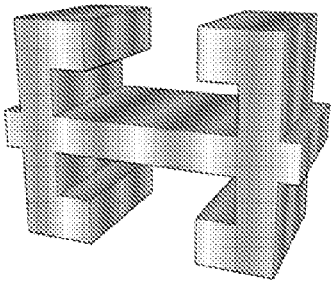
FIG. 9B shows an idealized 2D cell with top/bottom and left/right symmetry.
Figure 9C:
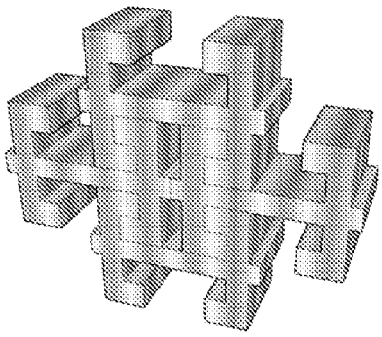
FIG. 9C shows an array of 2D cells depicted in FIG. 9B.

There are several cell connection mechanisms. One connection mechanism shown in FIGS. 9A, 9B and 9C is the locking barbs for quick snap together connecting. The legs bend slightly when the cells are joined and then hold together tightly.

Figure 10A:
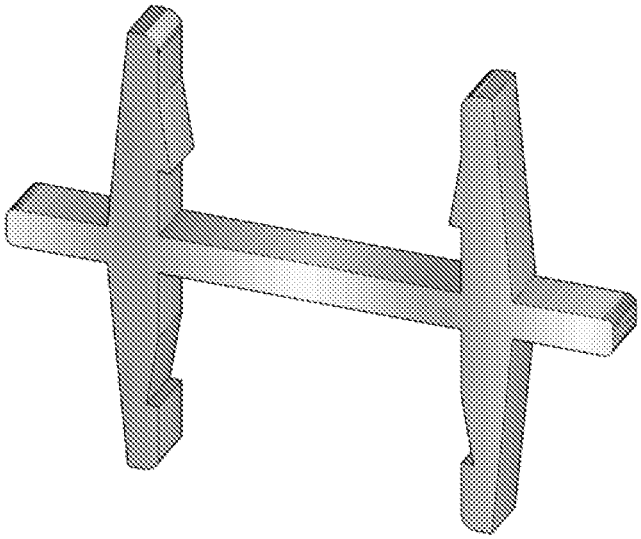
FIG. 10A shows a 2D cell that has left/right symmetry, but does not have top/bottom symmetry. This is called polarized because cells are connected in one direction.
Figure 10B:
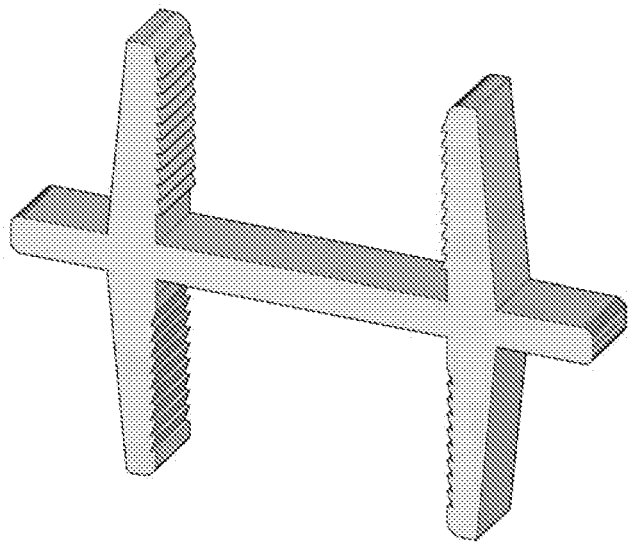
FIG. 10B shows a polarized 2D cell that uses the saw tooth connection mechanism.
Figure 11A:
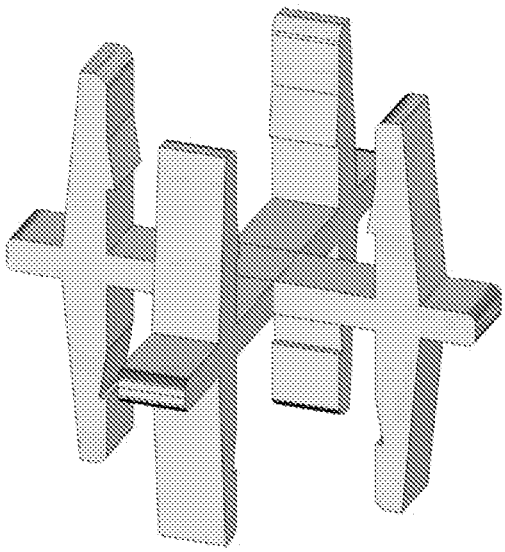
FIG. 11A shows a polarized 3D cell.
Figure 11B:
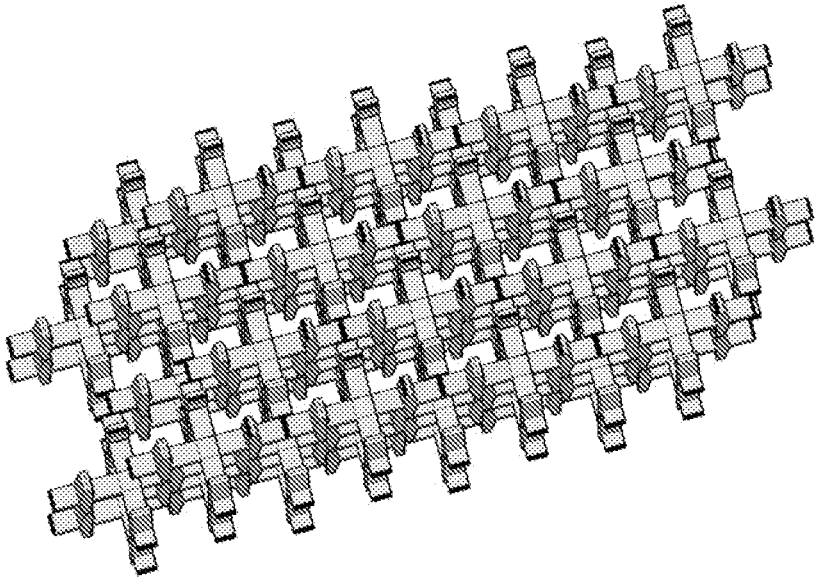
FIG. 11B shows a lattice of 3D cells.
Figure 11C:
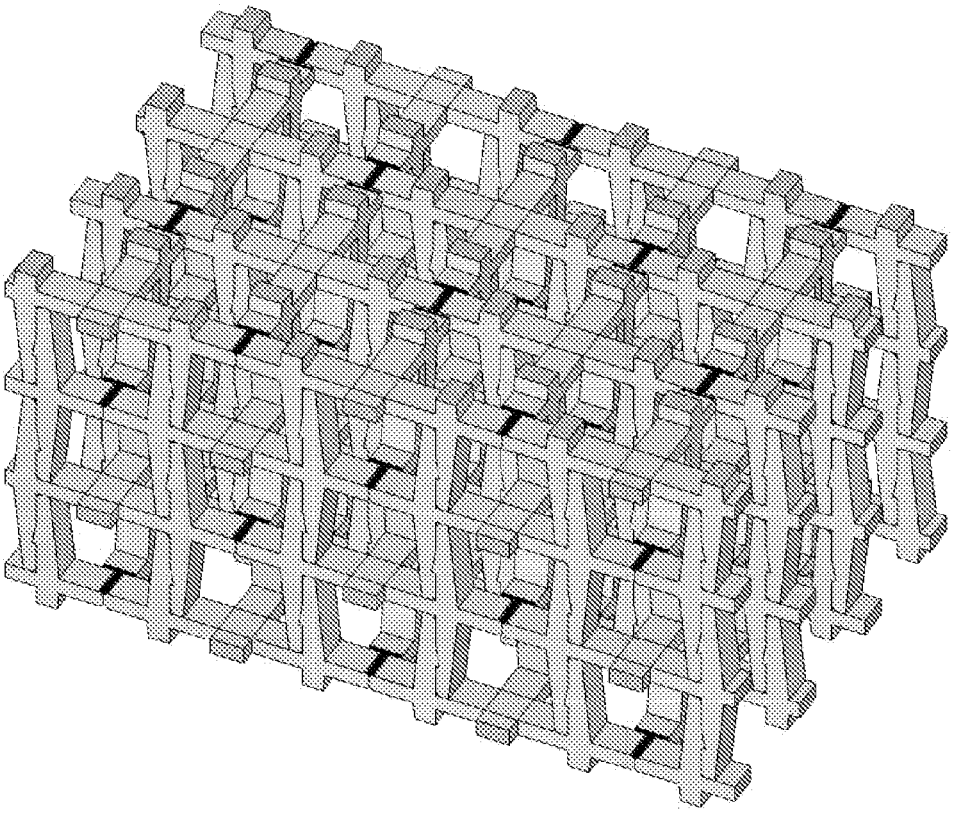
FIG. 11C shows a lattice of 3D cells with end pieces making the surface smoother.
Figure 12A:
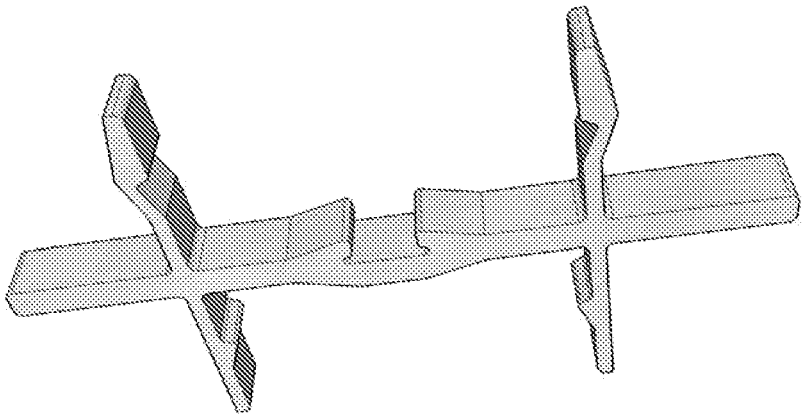
FIGS. 12A and 12B show the bottom and top 2D parts of a 3D cell. The two parts may be welded together.
Figure 12B:
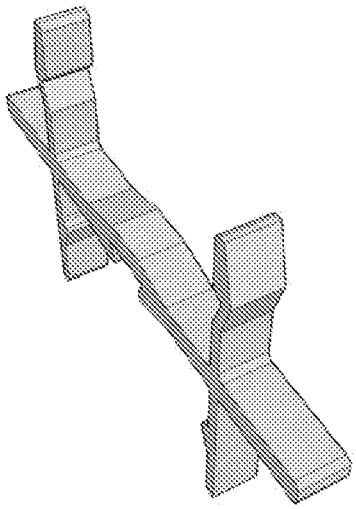
Figure 13A:
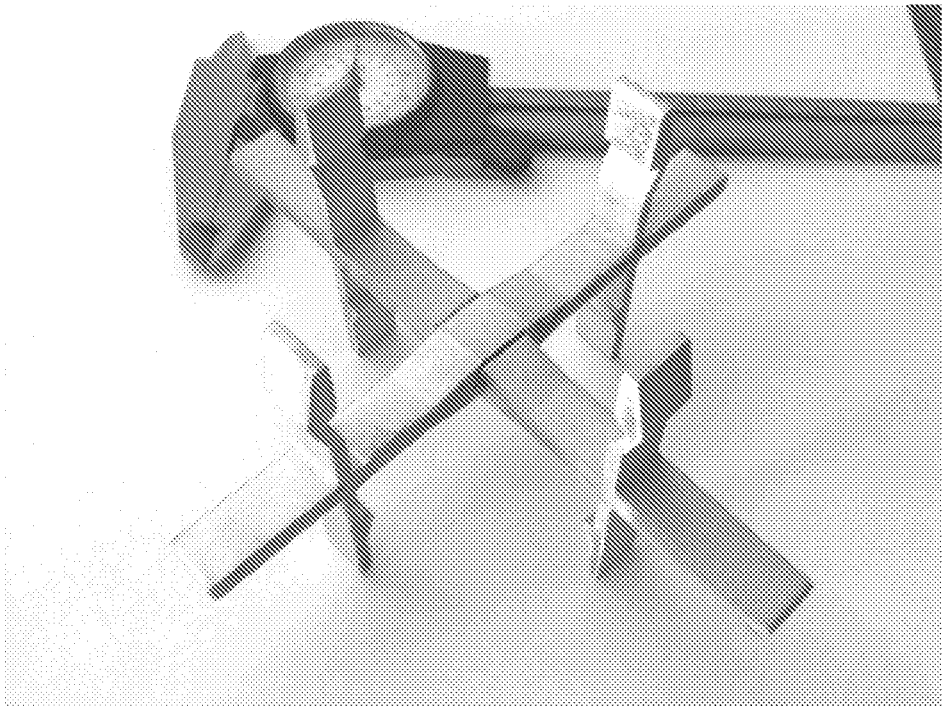
FIGS. 13A and 13B show pictures of a 3D cell and lattice made from aluminum. Sheet aluminum was water jet cut to produce the 2D cell parts, FIG. 14A show 2D cells connected to form an arch. The load on an arch keeps all cell intersections in compression, FIG. 14B show 2D cells connected to form an arch close up. Spacers can be inserted to form the arch shape or slightly curved 2D cells could be made.
Figure 13B:
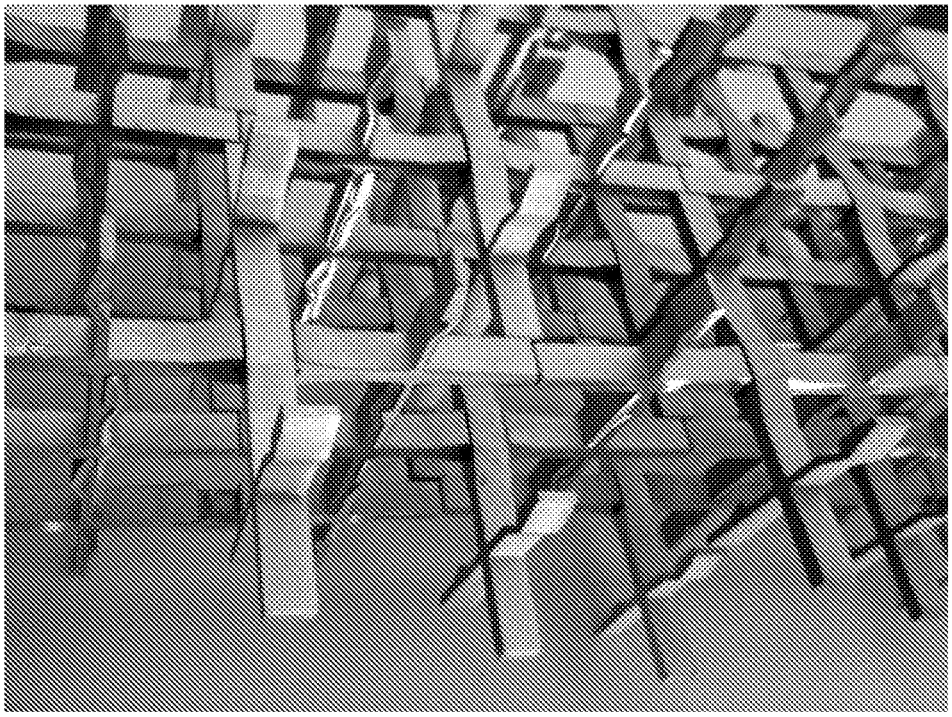
Figure 14A:
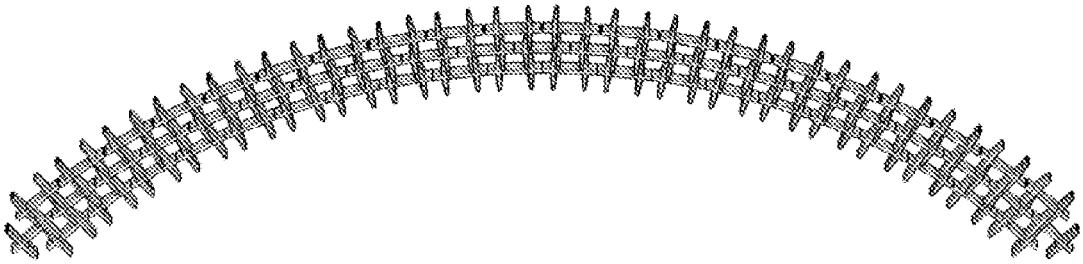
Figure 14B:
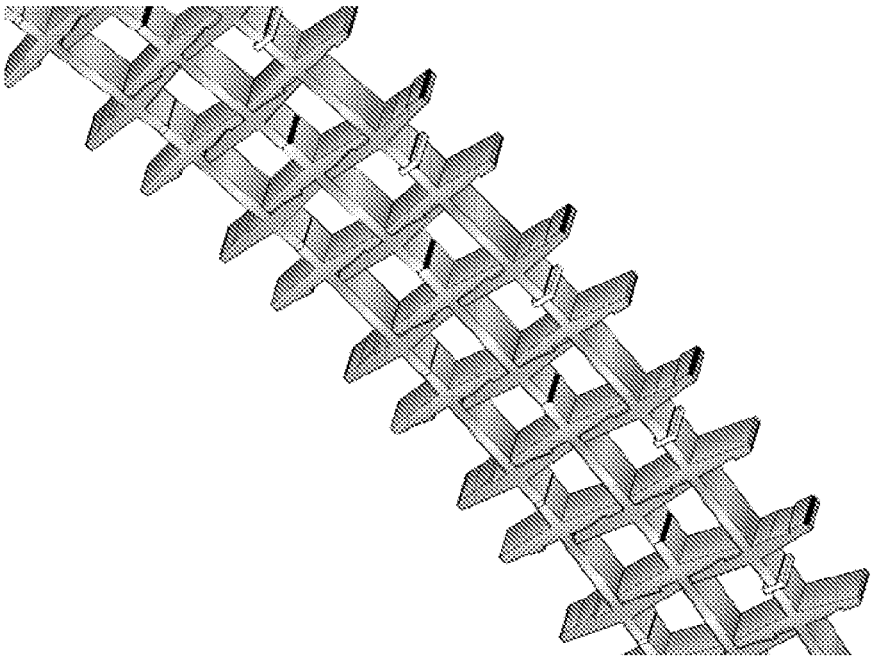

Another mechanism is the use of teeth as shown in FIGS. 10A-10B. This has the advantage of holding together at any point in the joining. It also has many points of contact for a strong connection.

Figure 18A:
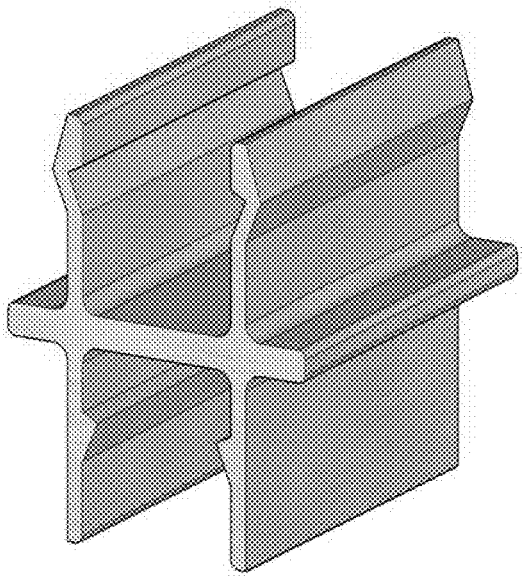
FIGS. 18A and 18B show a 2D cell and array made of extruded material. The sliding connection method is used.
Figure 18B:
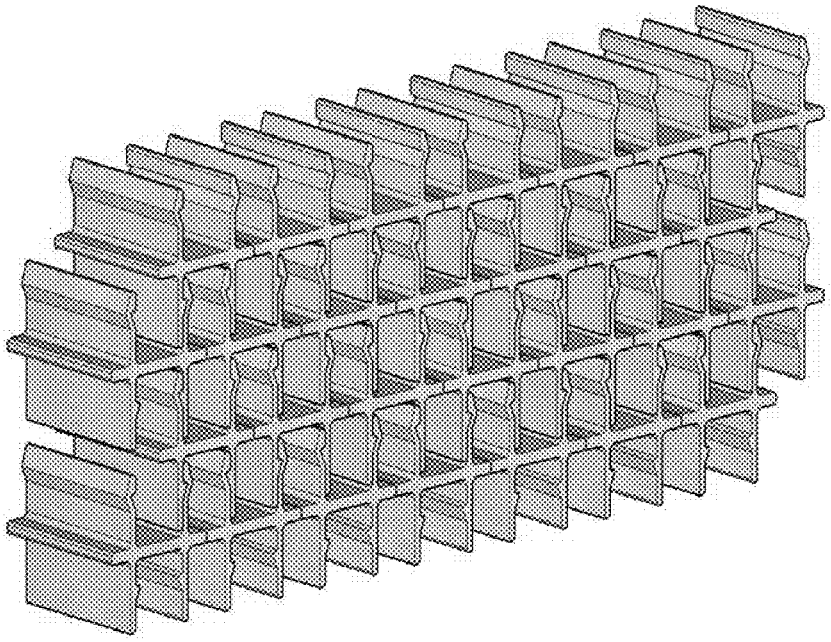

Another connection mechanism is the slide together mechanism as shown in FIGS. 9C and 18B. This is applicable preferably to 2D cells that have been manufactured by extrusion processes. The cells are joined by sliding sideways together.

Another connection mechanism is the twist together mechanism. A 3D cell can connect to four other 3D cells by positioning the cell legs close to the final position and twisting into place.

Another connection mechanism is side holes. A hole can be drilled through the two joined legs where a peg may be inserted. When using a mold to manufacture the cell, tubes may be inserted such that there will be holes in the legs of the resulting cell. See, for example, FIG. 3D.

Figure 17A:
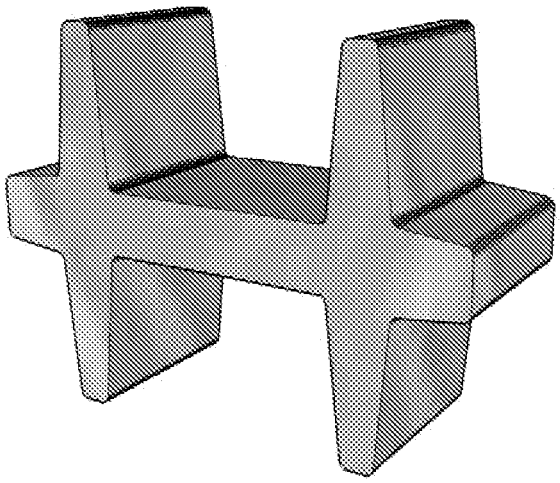
FIGS. 17A and 17B show a 2D cell and array where the cells are made in a mold. This applicable to concrete or ceramics implementations.
Figure 17B:
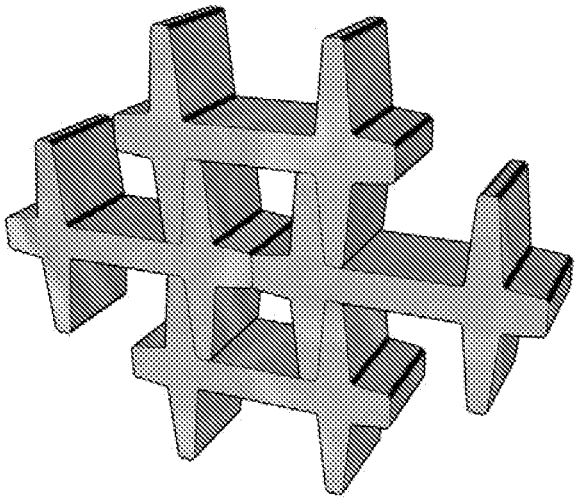
Figure 17C:
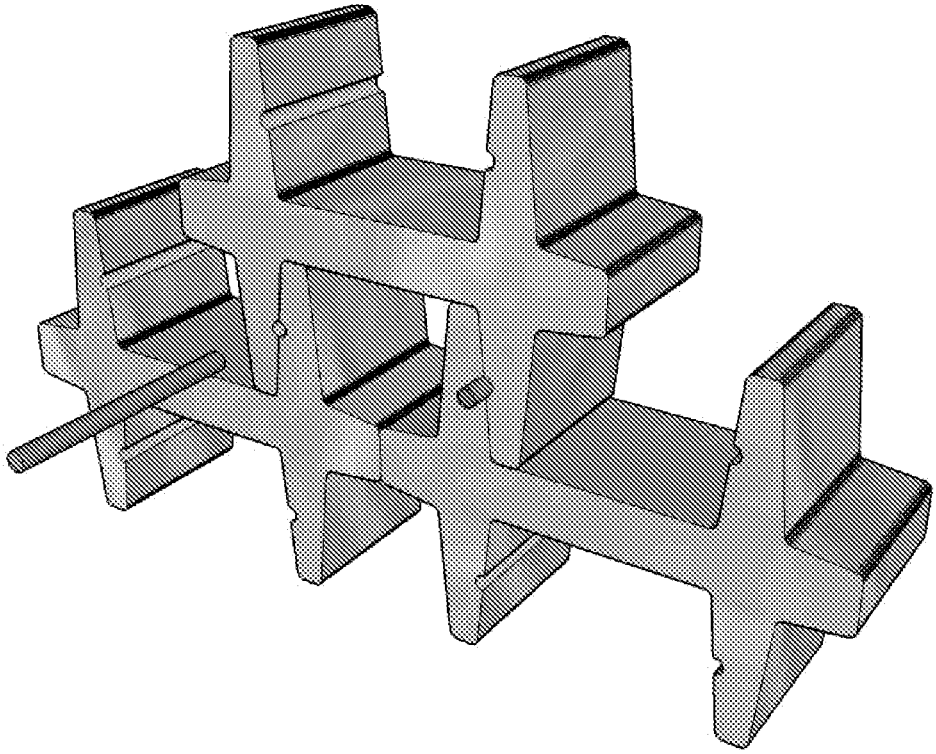
FIG. 17C shows a connection method for molded concrete cells.
Figure 17D:
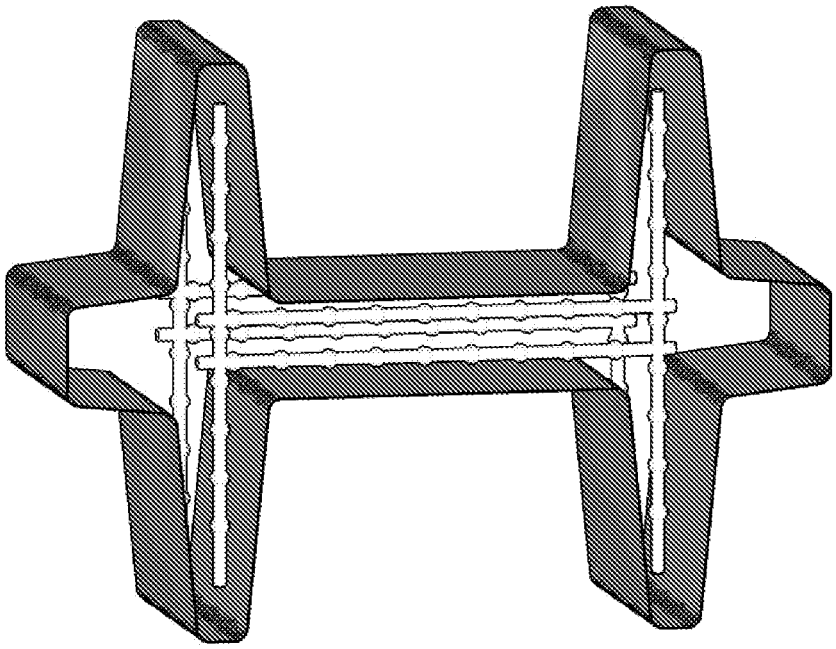
FIG. 17D shows how to reinforce a molded concrete cell. Reinforcement is preferably placed where tension forces are applied.

Another connection mechanism is front half holes. This is where the inside of the legs have a half circle groove such that when the two legs are joined, a dowel or peg may be inserted to prevent the cell connection from coming apart. See FIG. 17C.

Figure 25:
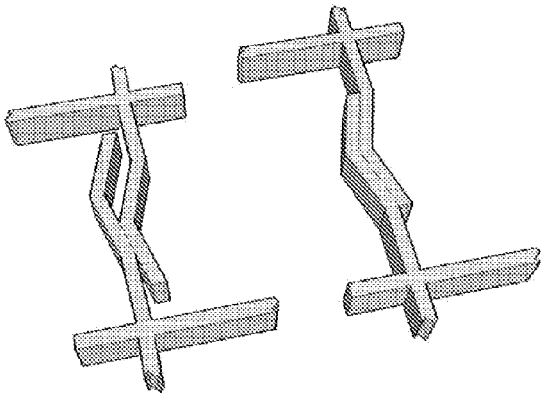
FIG. 25 shows legs of adjoining cells set in a sprung and un-sprung configuration. This connection method is used for intentional compressing of an array or lattice of cells.
Figure 26A:
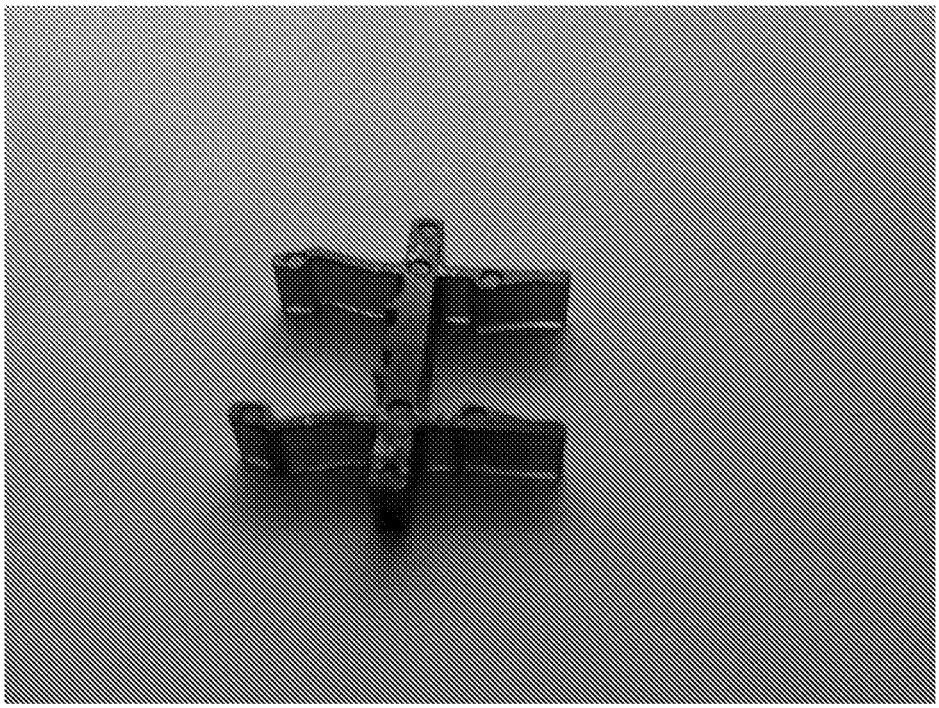
FIGS. 26A, 26B, and 26C show a plastic molded cell, a structure made out of the plastic cells, and a plastic cell array that can be used to validate finite element models of cell arrays.
Figure 26B:
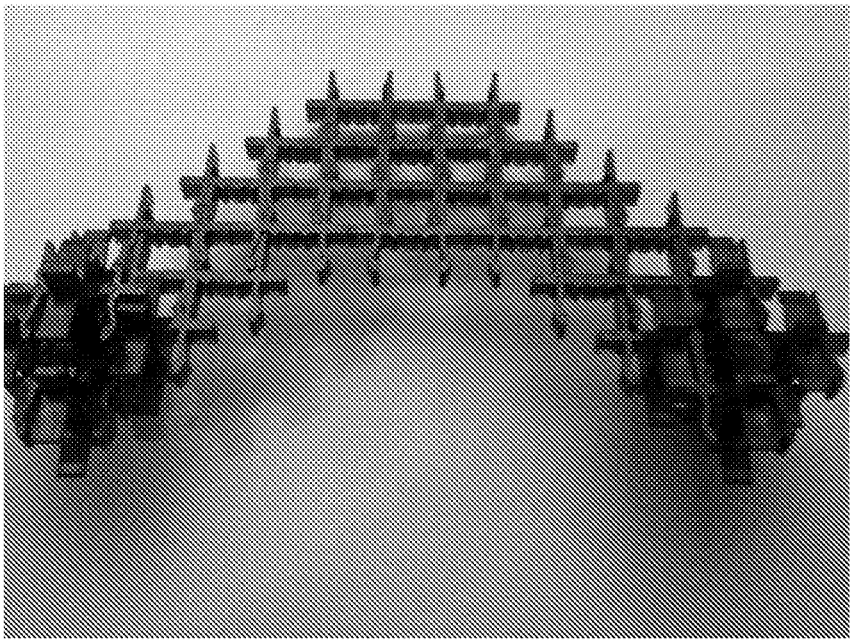
Figure 26C:
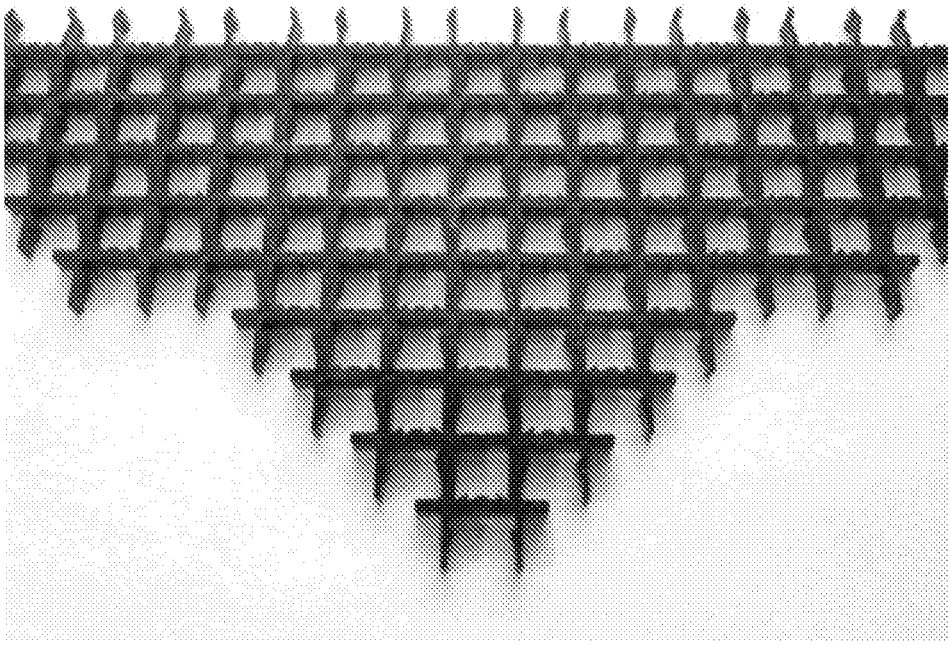
Figure 27A:
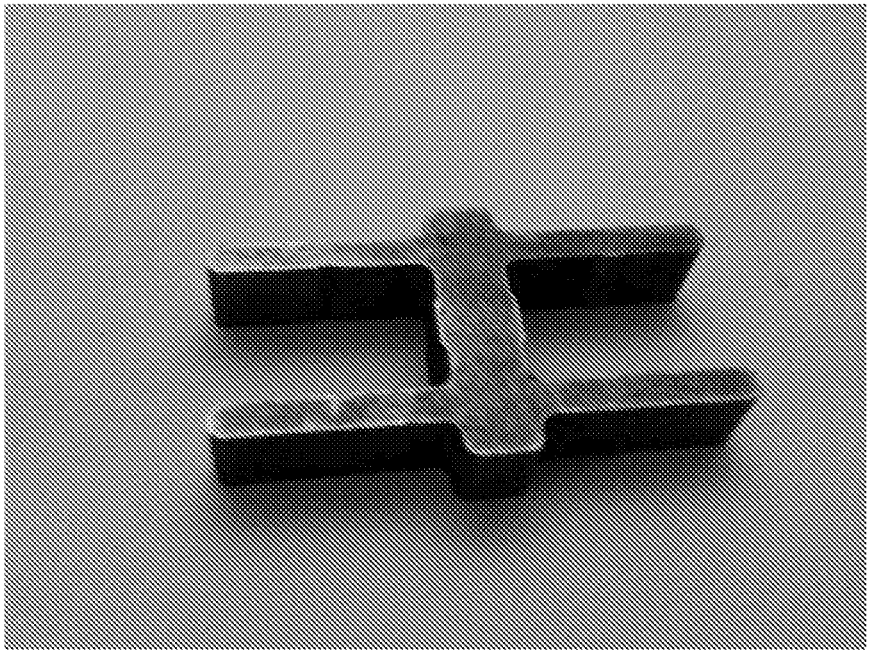
FIGS. 27A and 27B show a steel cell made using the electro deposit machining process, and an array of four steel cells connected.
Figure 27B:
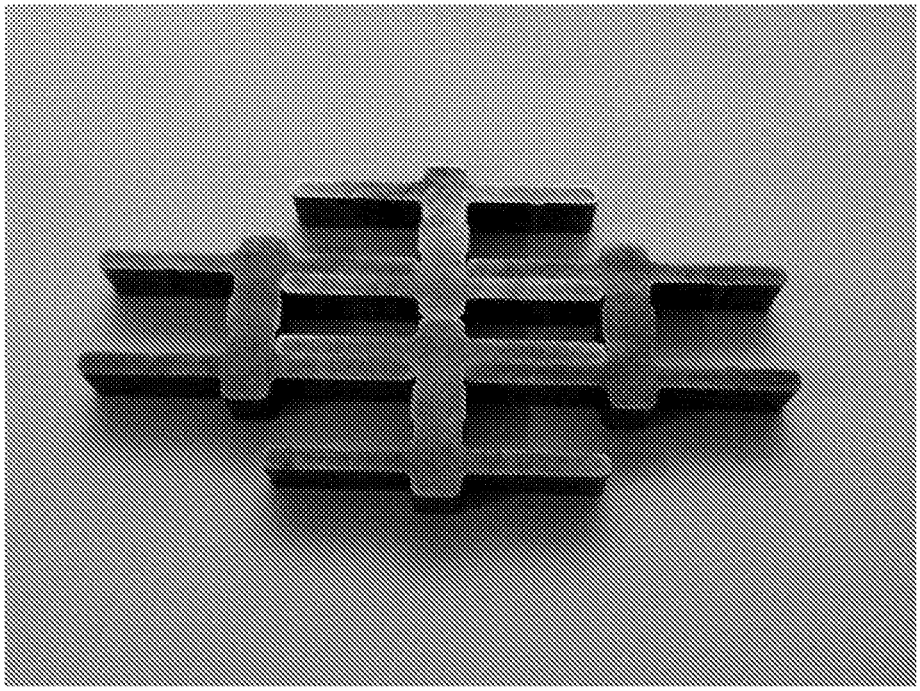
Figure 28:
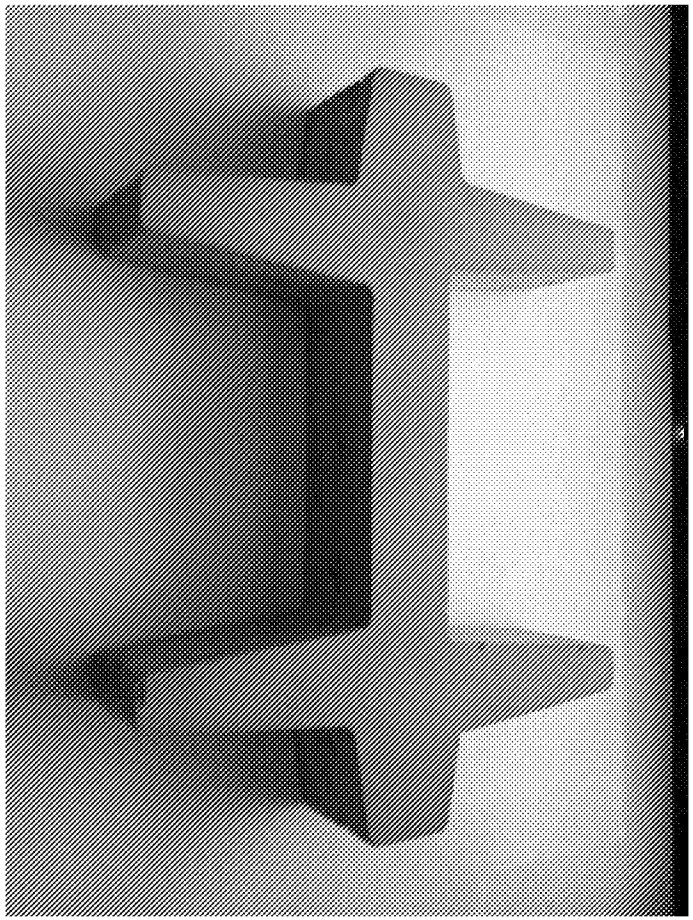
FIG. 28 shows a cell made using precast cement mix poured into a mold.

Another connection mechanism is the spring mechanism. It is similar to the locking barbs except the angles are shallow and allow movement after the cells are connected. Because of the outward spring nature of the legs, pushing or pulling on the cells imparts a spring force. See FIG. 25.

Another connection mechanism is friction coupled with gravity. In the case of concrete molded cells, they can be stacked upon each other and held in place by gravity. If the leg surface is rough, then friction is often times sufficient to hold the cells together.

Another connection mechanism is filling the open cell volume with a foam material after the cells have been formed into a lattice. This method provides advantages in holding together ceramic cells.

Figure 19A:
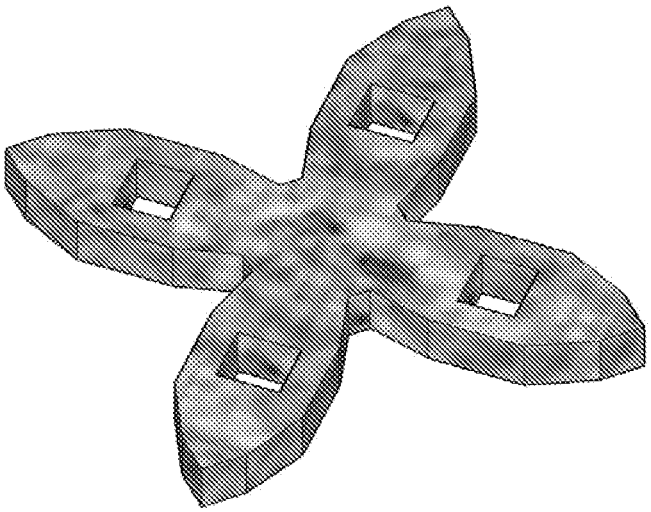
FIGS. 19A, 19B and 19C show how a 3D structure could be made by separating the manufacture of the middle cell bars and the cell legs. These cells could be stacked and gravity used to keep the structure connected.
Figure 19B:
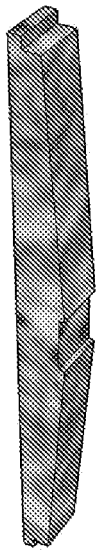
Figure 19C:
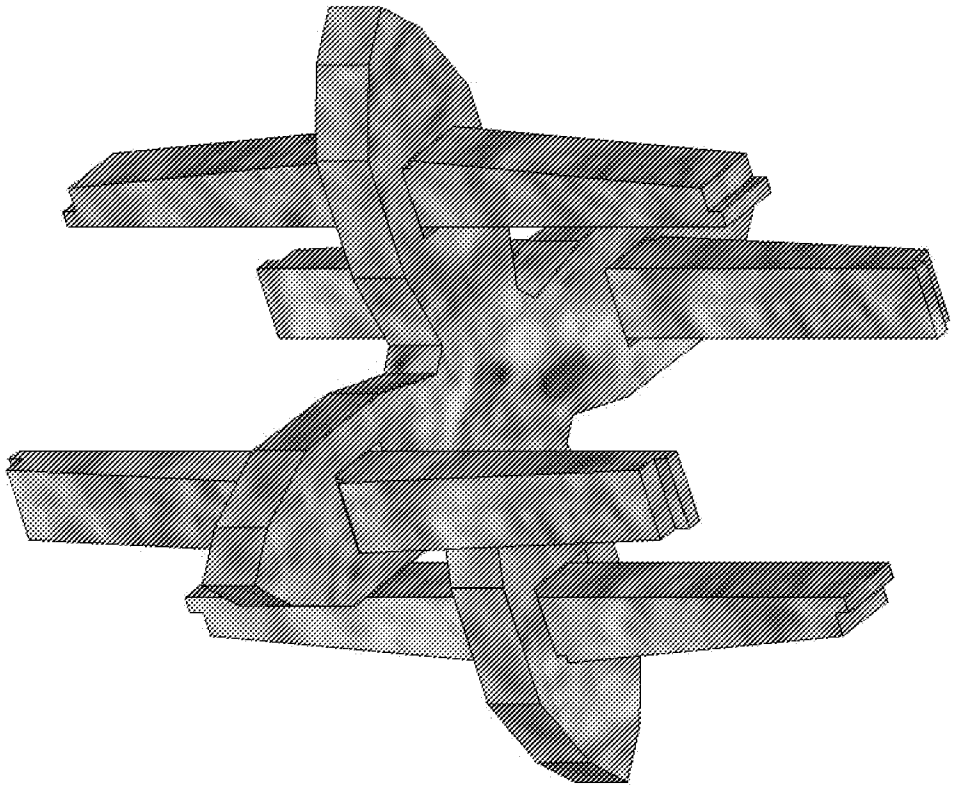
Figure 20A:
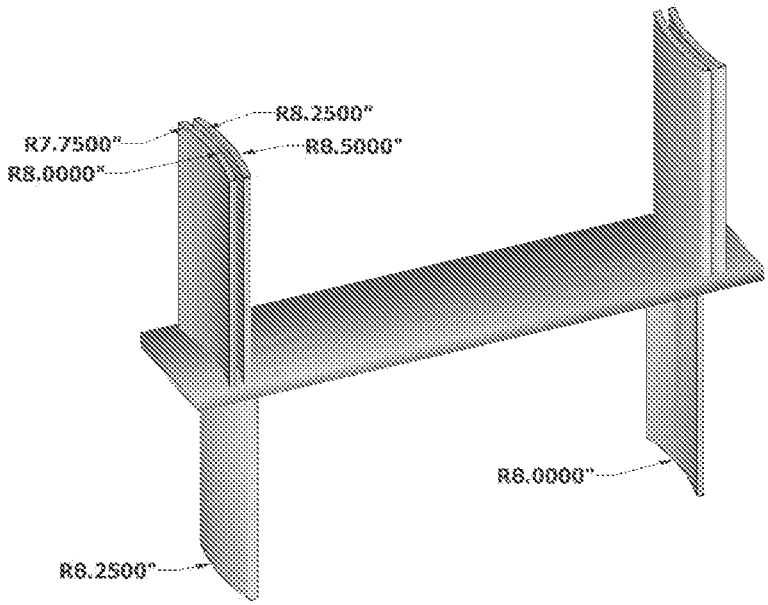
FIGS. 20A through 20D show cells made to connect using the twist together mechanism. In this embodiment, the center bars of adjacent cells do not need to touch because another set of inside legs are added to keep the cells apart. Each 2D cell, FIG. 20A, preferably has an upper half with two double legs and a lower half with two single legs. The single leg half of one cell twists to hold together the double leg halves of two cells. Connecting must proceed from lower layers to upper layers.
Figure 20B:
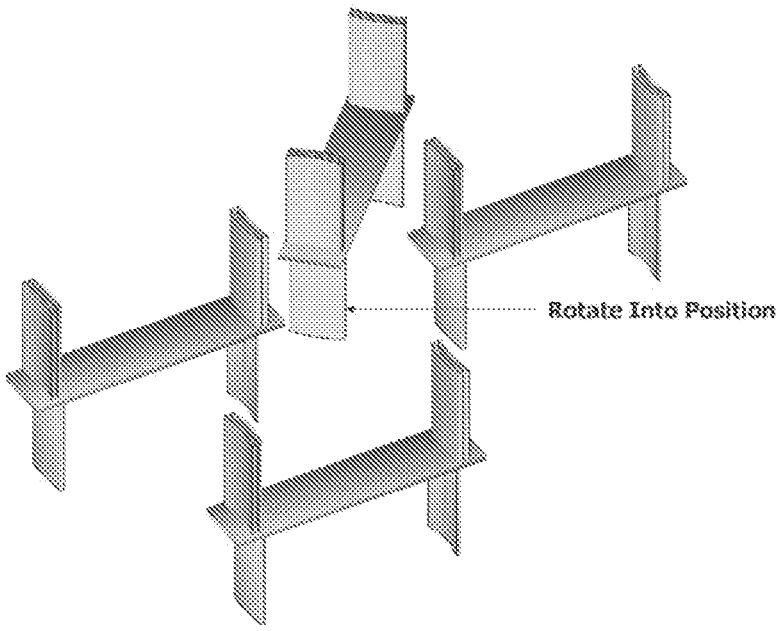
Figure 20C:
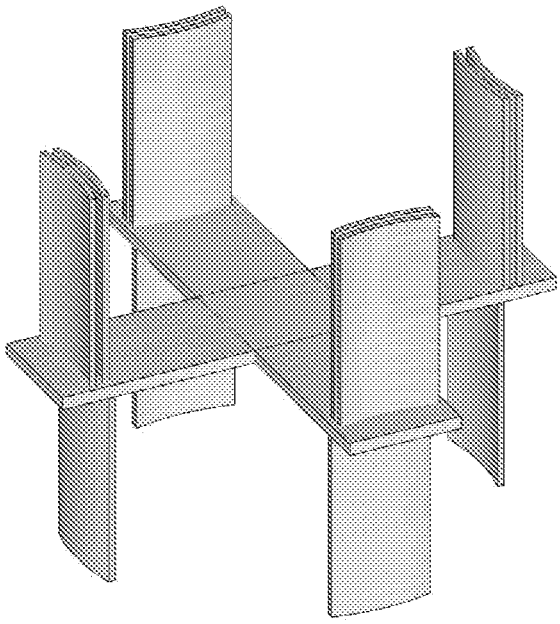
Figure 20D:
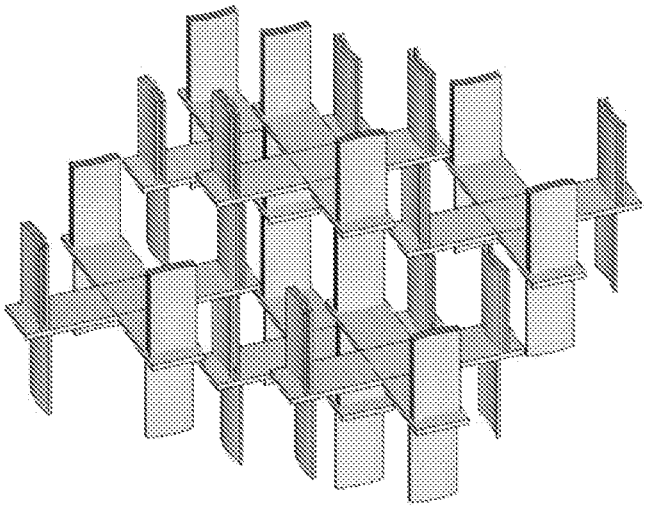

There are various solutions to the geometry of 3D cell intersections. This is where the ends of the legs of cells come together when 3D cells are connected into a lattice. One solution is the leg shortening solution. This is where cells in one direction have their legs shortened so they do not overlap the legs in the other direction. FIGS. 8B, 8C, 11A, 11B, 11C, 12A, 12B, 13A, and 13B, all show this solution being implemented. Another solution is the 90 degree solution. This is where the ends of the legs are cut to 90 degree points so that all four legs come together. See FIGS. 19A and 19C.

Figure 15A:
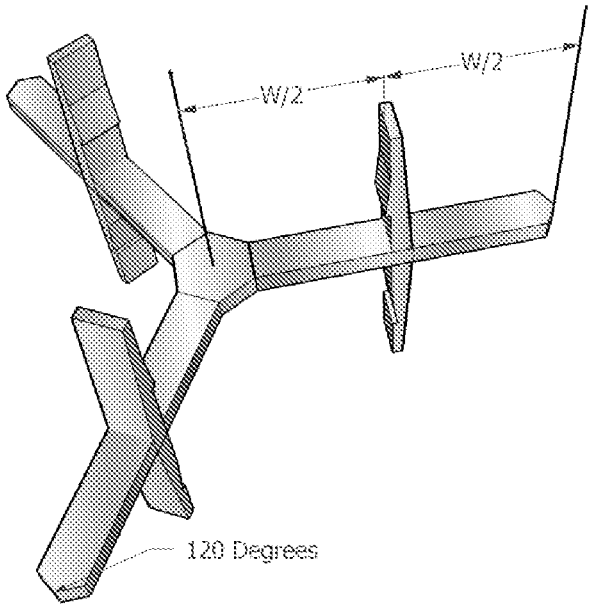
FIGS. 15A, 15B, and 15C shows a 3D cell, the beginning layer of a lattice, and a lattice that can be used for structures requiring strength against twisting, or can be used to produce a geodesic dome if spacers or slightly curved cells are used.
Figure 15B:
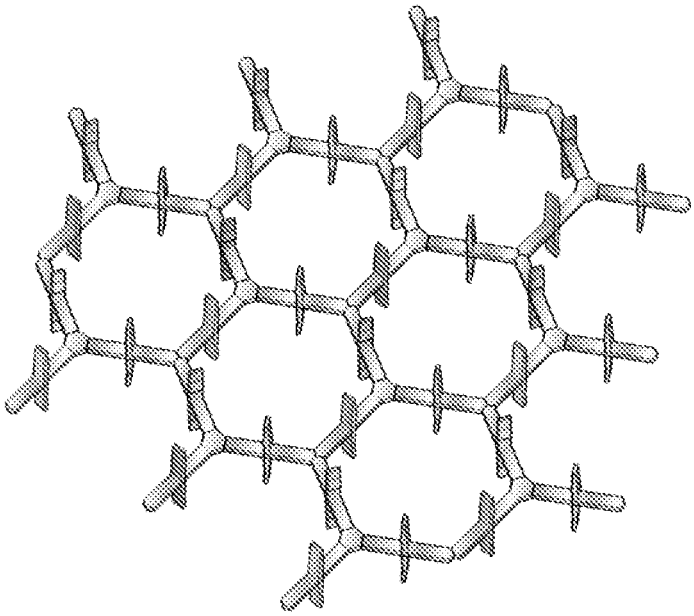
Figure 15C:
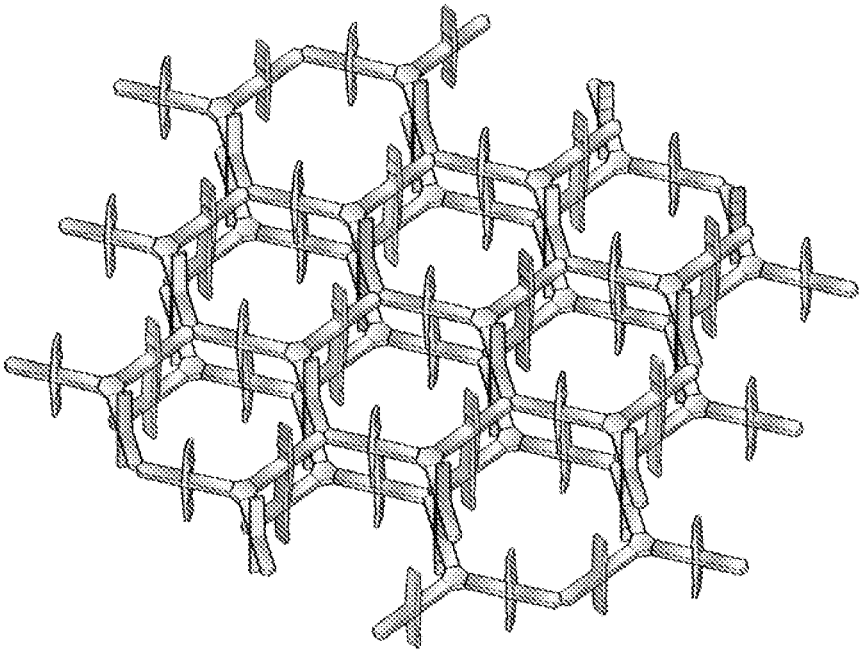

In the case of hex cells, three hex cell legs come together. One solution for this situation is where the ends of the legs are cut to 120 degree angles. See FIGS. 15A, 15B, and 15C.

Figure 16A:
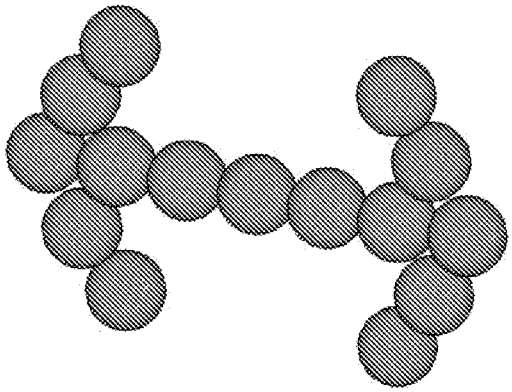
FIG. 16A shows a conceptual 2D cell made of a molecule. The possibility of a 3D cell is also hypothesized.
Figure 16B:
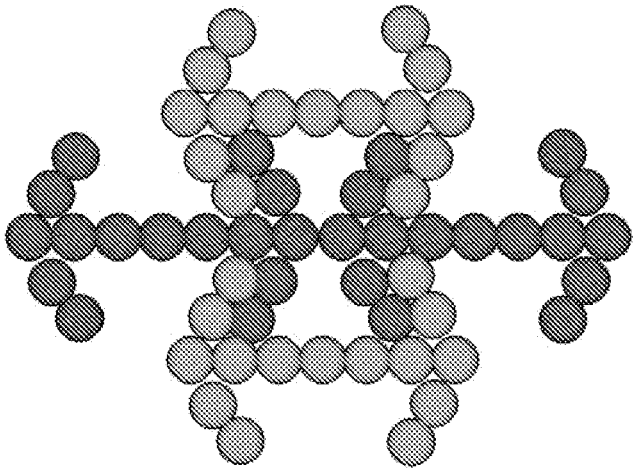
FIG. 16B shows an array of the 2D molecular cells. The molecule is not identified but its properties are that it consists of tightly bound atoms with a net neutral charge.

There are a variety of materials that may be used for a cell. For example, nano-scale molecules may be used to construct a cell. FIGS. 16A and 16B show an exemplary arrangement of molecules wherein no particular molecule is identified. The cell molecule would have very strong bonds with its own atoms but could be charge neutral with other cells. In this embodiment, the geometry is the principal means to hold them together rather than a chemical bond.

For concrete and ceramics, cells are preferably moldable. In this embodiment, cells have rounded corners and beveled legs for mold release. Concrete cells preferably incorporate reinforcing rods or bars for stress points and places where tensile strength is required. Ceramic cells have the potential to have much higher tensile strength (psi) as the size of the cell decreases. The material is also inexpensive, so ceramic cells could result in lightweight and strong bulk material that has low density and toughness at low cost.

A variety of materials may be used in the present invention, each exhibiting different characteristics. Wood is aesthetically attractive. A steel plate attached to the wood cell provides it the proper tensile strength in all directions. Aluminum is a good material for most cell geometries including extrusion. Plastic is a good material for most cell geometries. Injection molding is typically the least expensive method to produce cells. Vacuum forming is ideal for large play toys.

Carbon composites can be used to make cells. Care must be taken to analyze the stress points and tensile strength used in the application. This material has the potential to make very large beams that are very light and strong. The advantage of using cells is that the resulting beam is toughened. In the event of failure or damage to cells, the beam remains intact. Manufacturing many small composite parts may be much less expensive than few larger parts.

There are many applications of the invention. The following are provided as non-limiting examples.

Figure 21:
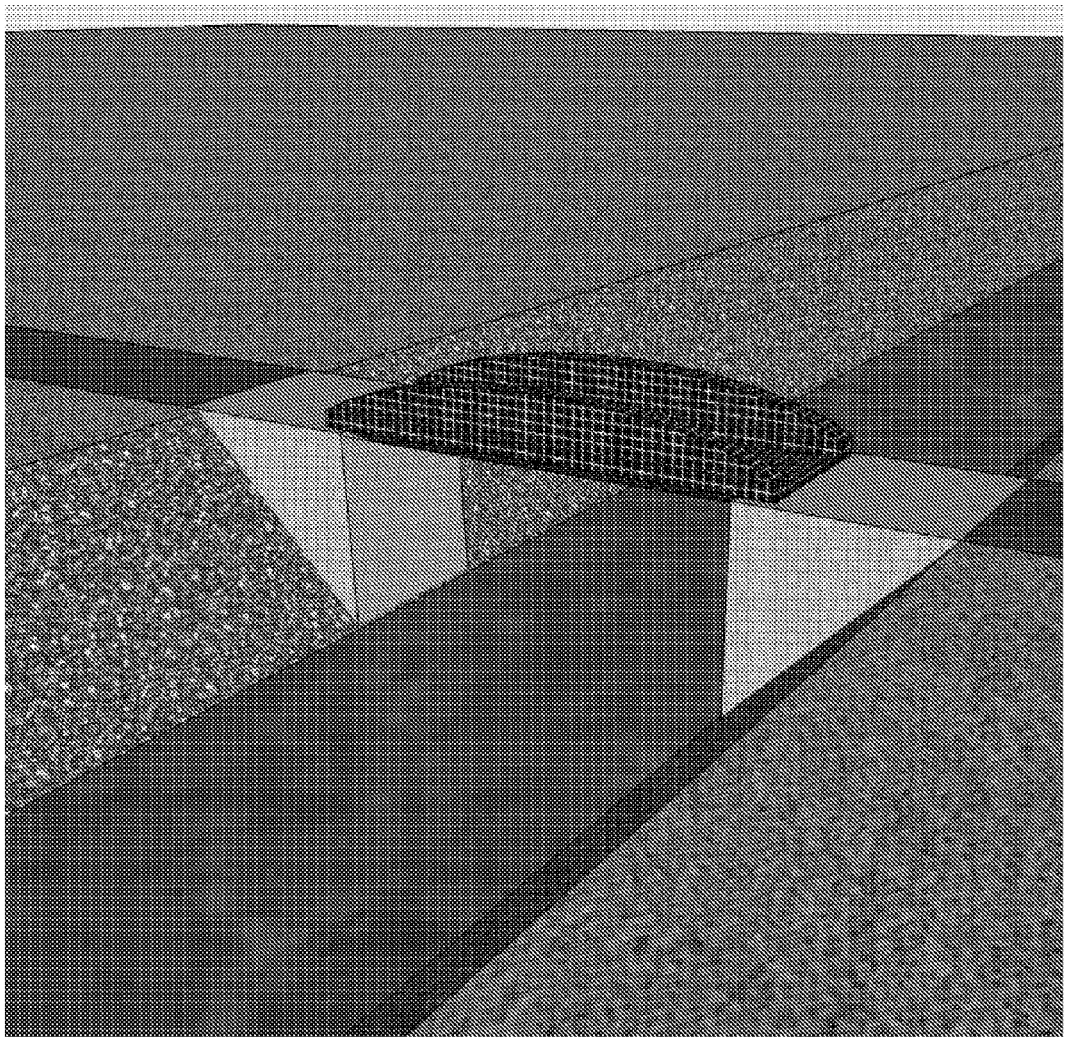
FIG. 21 shows a bridge built with 3D cells. The bridge could be assembled by one person and without the use of a crane. The height and width of the sides of the bridge can easily be varied to produce the required strength. The road bed is made of cells extended from the sides.
Figure 22:
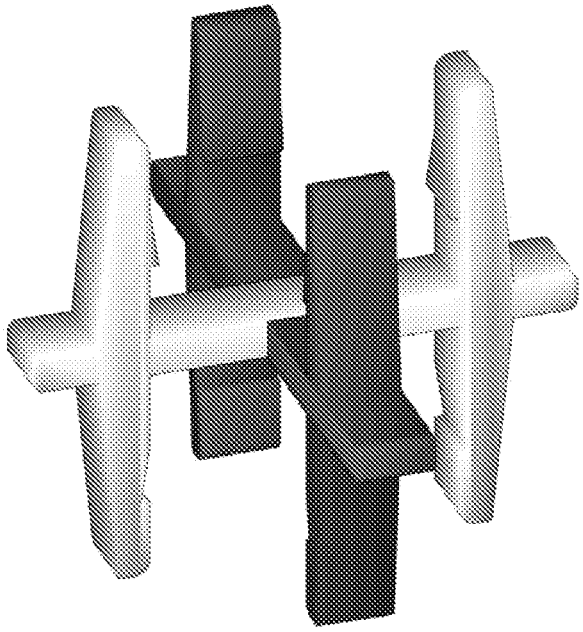
FIG. 22 shows a toy cell. It would be made of plastic, possibly molded or by using vacuum forming.
Figure 23:
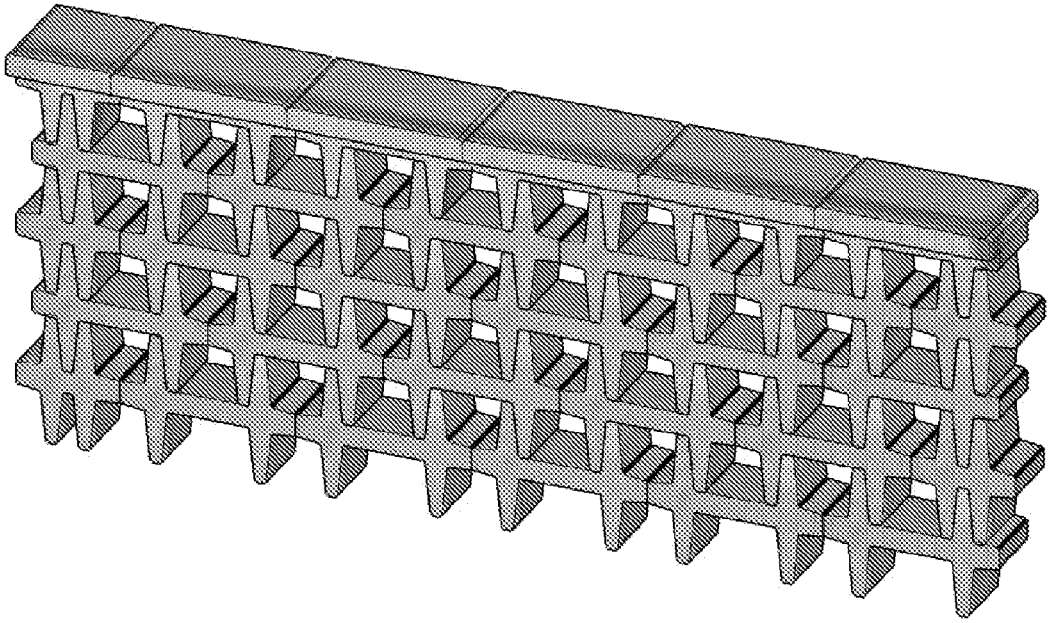
FIG. 23 shows a fence made using pre-cast concrete cells. The cells have steel wire or bar reinforcing rods for tensile strength. The fence could simply use gravity and friction to hold the cells together. If the through hole connecting mechanism was used, the fence could span a gully or a stream.
Figure 24:
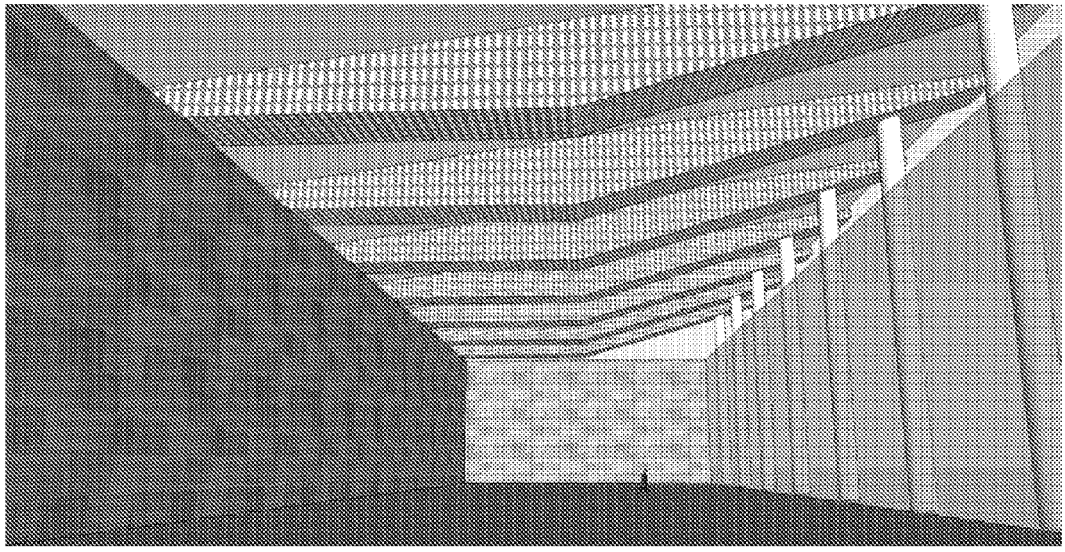
FIG. 24 shows 3D cell lattices used as roof beams of a large building such as a convention center. The roof beams are open celled and would allow light to filter through them.

Beams and bridges are an important application. The arrangement of cells can be optimized to minimize the material and maximize the strength where it is required. Using arches put the cells in compression where they can be very strong. A bridge or beam may be constructed without large cranes because an initial starting beam is constructed and then cells added until the desired strength is obtained. The structure is also resistant to corroded or damaged cells because of the massive redundancy of cells. See, e.g., FIGS. 21 and 24.

Figure 15D:
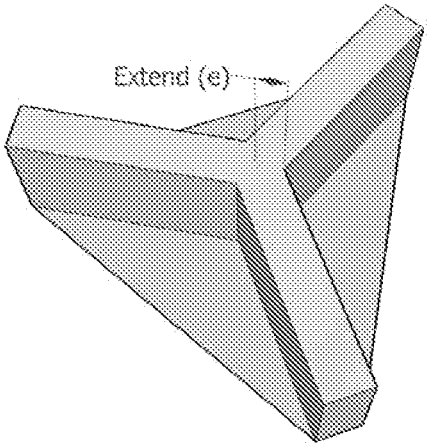
FIG. 15D shows a spacer that can be inserted at the intersection points of a hex lattice to make a spherical shape such as part of a geodesic dome.

Geodesic domes may be made from the hex cells. With a slightly larger leg size in outer shells, the cells will naturally produce a dome and will come together as parts of a geodesic. FIG. 15D shows an example of a spacer. In a multi-layer implementation, an outer layer preferably has larger spacers than the next inner layer. If the radiuses of the inner and outer layers are not too much different, then the spacers can have an Extend dimension that is small. This allows the use of one standard cell for all layers as long as the connecting legs have the required flexibility.

Large size cells that are easy to connect and disconnect may be used for scaffolding.

Mattresses or cushions may be made out of a lattice of cells that use the spring connection method.

Airless tires may be made of arch shaped cells connected using the spring connection method.

Construction toy kits or sets make forts and shapes.

Fences may be made that would be easy to assemble, having a long life cycle, and have the strength to span gullies above the ground. 3D versions may be used as a bulwark where fill dirt can be dumped into the open cells.

Hedges and arbors may be constructed that can have plants growing within the open cell structure.

Outer space structures are another application. Cell parts may be efficiently packed in a small space for lifting into orbit. Easily connectable and disconnectable cells may be used to make large 3D structures.

Aircraft parts may be made out of carbon composite cells.

A robotic mechanism could be created that when fed cells from a cartridge would travel and climb to form a building. If the robot could also disconnect cells already installed, then the robot could create its own scaffolding as required. More cells producing thick walls may be used in the foundation and lower floors of a building and taper off as the building gets higher. Cranes would not be required for building construction.

There are many manufacturing methods that depend on the material being used. For example, cells can be manufactured using extrusion, water jet cutting, injection molding, with precast concrete molding methods, with milling machines, and with die cast molds.

Figure 29A:
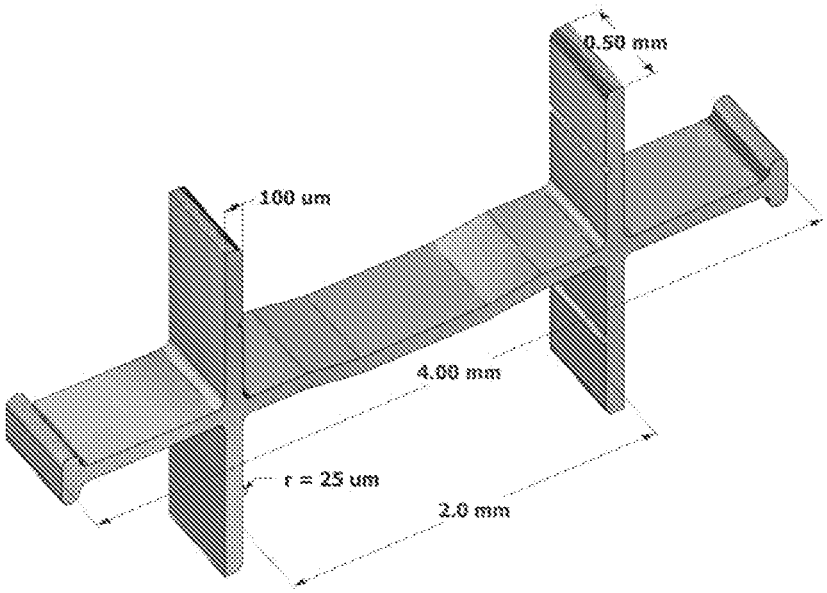
FIGS. 29A through 29E show a silicon cell made using MEMS technology.
Figure 29B:
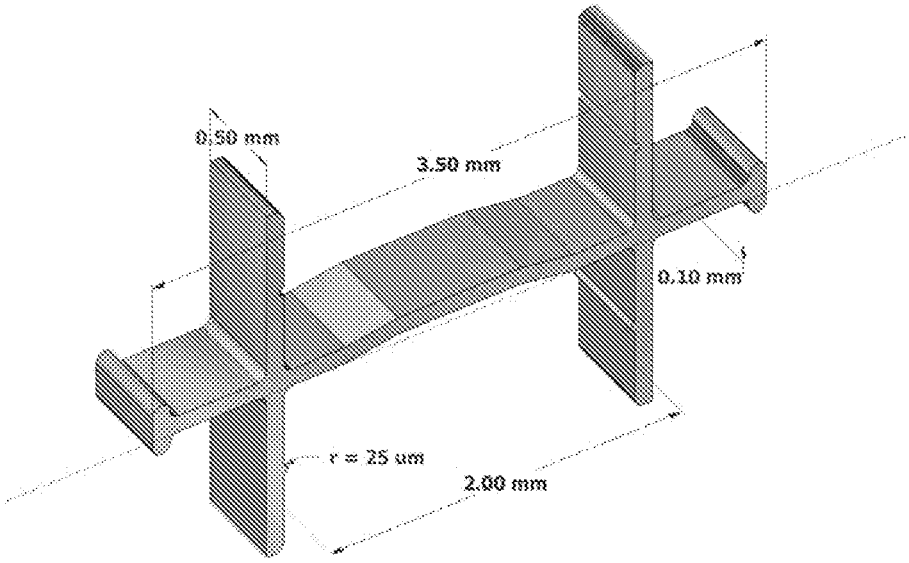
Figure 29C:
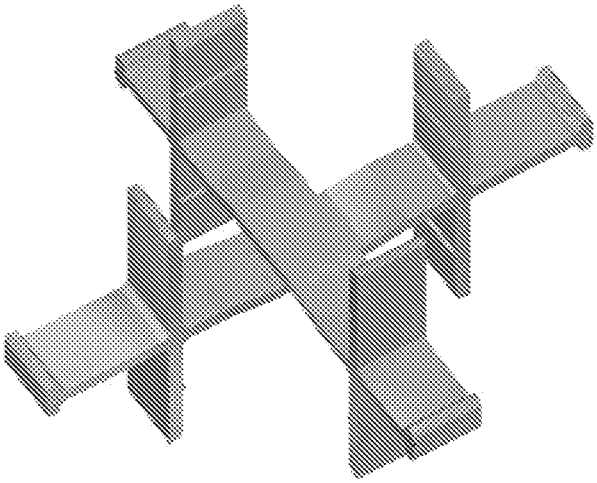
Figure 29D:
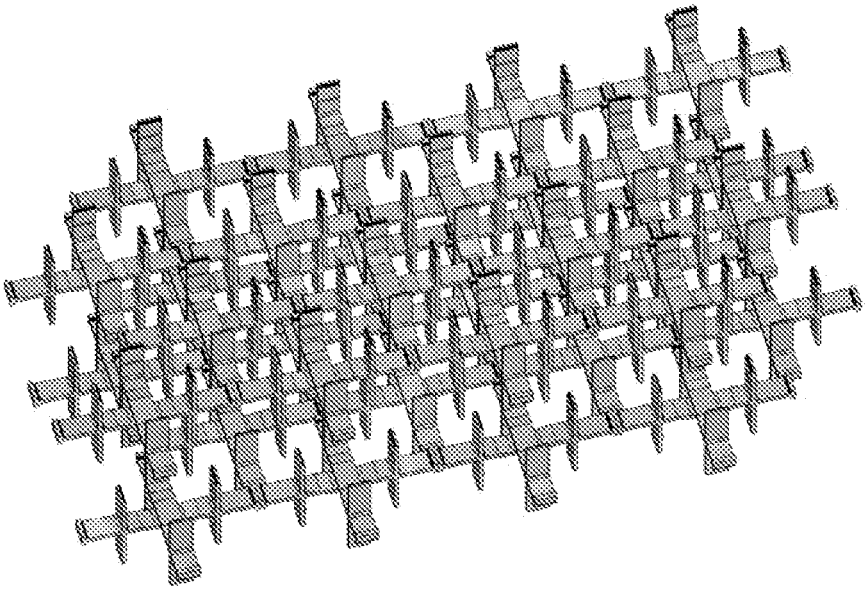

Another manufacturing method that can be employed is one used to produce MEMS (Microelectromechanical Systems) devices. FIGS. 29A through 29E show an example using silicon as the material and the DRIE (Deep Reactive Ion Etching) manufacturing method. The parts shown in FIGS. 29A and 29B are welded together at 90 degrees to create a 3D cell, FIG. 29C. Welding can be done with silicon by heating the joint, for example, with a laser. The cells preferably use the leg shortening intersection method. A fine grained lattice of cells may be produced. Possible applications are as a structural material or as scaffolding for mounting other MEMS parts.

Figure 29E:
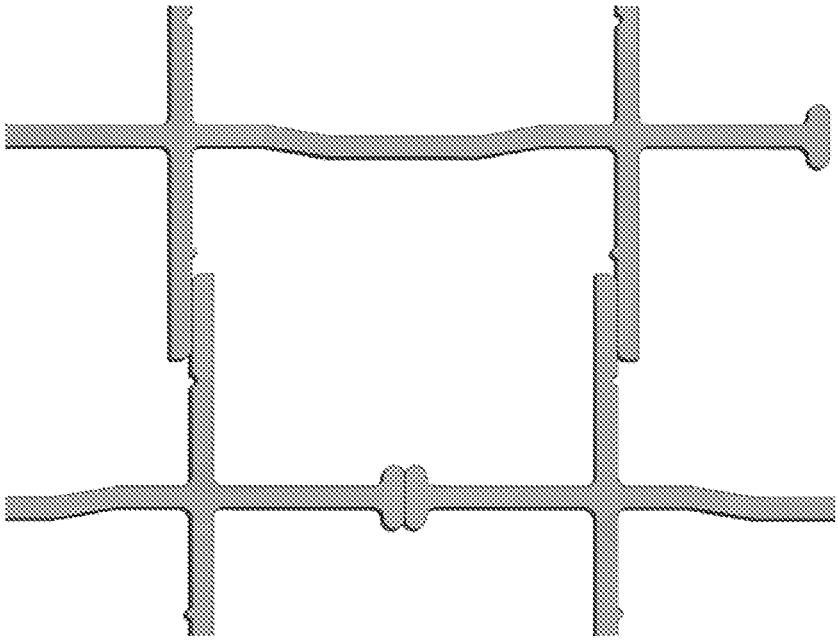

FIG. 29E shows a close up of one axis of a silicon cell connection. Simple guidelines are preferably used to help determine the dimensions of the guide, barb, and recess used in the connection. See, for example, FIG. 1 showing the guide 15, barb 35, and recess 30. For the silicon cell, the guide is preferably a rounded edge, the barb is a half circle protrusion, and the recess is a half circle indent. One 3D cell is positioned above four lower cells at an intersection and pushed into place. Assuming the arms of the cell are simple rectangular cross sections and the center bar is being held in place, the force required to bend the arm at a point of distance L above the bar is dependent on E, the Young's Modulus of the material, the width V of the leg, the depth W of the leg, and the distance D of the leg has been displaced. As an approximation, assume the angle of bending is small, tan(theta)~=theta. The force is E*V*W*D*(V/L)^2/(12*L). For silicon, E~=100 GPa. The largest displacement that is allowed is dependent on the maximum yield stress of the material, which is about 5000 MPa for silicon. Dmax-silicon is 2*5000e6*L^2/(E*V). For the silicon cell, the insertion force worst case is bending the end of the leg at the guide a distance D and doing that for all four legs. This assumes the protrusion touches at a 45 degree angle to the guide. F=1.0e11*1e-4*5e-4*25e-6*(1e-4/1e-3)^2/(12*1e-3)=0.104 Newtons per Leg (about 10.6 grams force/leg).

While the preferred embodiment of the invention has been illustrated and described, as noted above, many changes can be made without departing from the spirit and scope of the invention. Accordingly, the scope of the invention is not limited by the disclosure of the preferred embodiment.

The embodiments of the invention in which an exclusive property or privilege is claimed are defined as follows:

1. A method for connecting unitary cellular building blocks comprising:

aligning the distal ends of one beam from three blocks each having three equal length beams with a proximal end and a distal end and a top surface and a bottom surface, wherein the three beams of each block are joined in unitary fashion at their proximal ends, at least one leg extending substantially perpendicular from the top and bottom surfaces of each of the three beams of each of the three blocks, each leg having an inner edge extending from the top surfaces of the beams shaped complementary to an inner edge extending from the bottom surfaces of the beams; and aligning the inner edges of at least one leg extending substantially perpendicular from a bottom surface of each of three beams of a fourth block with the inner edges of the at least one leg extending substantially perpendicular from the top surface of each of the three beams of each of the three blocks, wherein the inner edges of the fourth block legs extending from the bottom surface of the fourth block beam is shaped complementary to the inner edges of the legs of the three blocks extending from the top surface of the beams of the three blocks.

2. The method of claim 1, comprising aligning the aligning the inner edges of at least one leg extending substantially perpendicular from a top surface of each of three beams of a fifth block with the inner edges of the at least one leg extending substantially perpendicular from the bottom surface of each of the three beams of each of the three blocks, wherein the inner edges of the fifth block legs extending from the top surface of the fifth block beam is shaped complementary to the inner edges of the legs of the three blocks extending from the bottom surface of the beams of the three blocks.

* * * * *